US006511150B1

(12) United States Patent
Yoda et al.

(10) Patent No.: US 6,511,150 B1
(45) Date of Patent: Jan. 28, 2003

(54) INK JET PRINTER, AN INITIALIZATION CONTROL METHOD THEREFOR, AND A DATA RECORDING MEDIUM

(75) Inventors: Satoshi Yoda, Suwa (JP); Atsushi Nishioka, Suwa (JP); Mitsuaki Teradaira, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/407,160

(22) Filed: Sep. 28, 1999

(30) Foreign Application Priority Data

Sep. 29, 1998 (JP) ..... 10-276213

(51) Int. Cl.[7] ..... B41J 2/165
(52) U.S. Cl. ..... 347/23
(58) Field of Search ..... 347/23, 29, 32, 347/33, 5, 14, 19; 358/1.15

(56) References Cited

U.S. PATENT DOCUMENTS

| | | | | |
|---|---|---|---|---|
| 5,543,826 A | | 8/1996 | Kuronuma et al. | 347/23 |
| 6,036,299 A | * | 3/2000 | Kobayashi et al. | 347/30 |
| 6,359,701 B1 | * | 3/2002 | Yamada et al. | 358/1.2 |

FOREIGN PATENT DOCUMENTS

| | | | | |
|---|---|---|---|---|
| EP | 0 289 743 | | 11/1988 | |
| EP | 0 765 752 A1 | | 4/1997 | |
| EP | 0 836 945 A2 | | 4/1998 | |
| EP | 0 844 094 A2 | | 5/1998 | |
| JP | 404115979 A | * | 4/1992 | 358/1.15 |
| JP | 04220351 A | * | 8/1992 | |
| JP | 04220351 | * | 8/1992 | |

* cited by examiner

*Primary Examiner*—Shih-wen Hsieh

(57) ABSTRACT

An ink jet printer capable of performing an appropriate initialization process when power is turned on again when a cleaning process is in progress when the power is suddenly interrupted by a power failure or disconnection of the power cord. The present invention comprises a maintenance unit for an ink jet head; a memory 103; a power interruption detector 105 for detecting interruption of power supply to the printer; a storage controller 100 for storing a current operating status of the maintenance unit to the memory 103 when the power interruption detector 105 detects interruption of the power supply; and an initialization controller 100 for reading the maintenance unit operating status stored to the memory 103 when printer power is turned on, and performing different initialization operations according to the operating status.

28 Claims, 17 Drawing Sheets

Ink Suction

Dry Suction

INK JET PRINTER, AN INITIALIZATION CONTROL METHOD THEREFOR, AND A DATA RECORDING MEDIUM

BACKGROUND OF THE INVENTION

1. Field of the Invention

The present invention relates to an ink jet printer, to an initialization control method therefor, and to a computer-readable data storage for storing a computer program achieving this initialization control method. More specifically, the invention relates to a novel method for improving the initialization of a printer when power supply to the printer is interrupted while a print head cleaning process is in progress.

2. Description of the Related Art

Ink jet printers use a non-contact printing method whereby ink inside an ink chamber is pressurized at very short time intervals, causing ink droplets to be ejected by the generated pressure from the ink nozzles and adhere to the recording medium. Movement of the print head with a carriage and advancement of a recording medium enables the ink drops to be arrayed in a two-dimensional dot matix on the recording medium surface to form text, graphics, and other print images. When compared with impact printers, ink jet printers are, generally speaking, quieter, faster, cost less to operate, and can be easily adapted for color printing.

The use of liquid ink, however, makes the maintenance and care of ink jet printers more troublesome. In particular, ink and foreign matter such as paper dust adhering to the nozzle area can clog the nozzles and thus affect the trajectory of ink drops. When there is a build-up of ink and dust on the nozzle surface, they can also smear the recording medium and thus contribute directly to soiling the recording medium and waste.

Dirty nozzles also contribute directly to reduced print quality, and keeping the nozzles as clean as possible is therefore important. For this reason, conventional ink jet printers typically have a cleaning mechanism for regularly cleaning the nozzles and maintaining consistent print quality.

Some types of ink jet printers are capable of cleaning with an ink suction process or two different levels of so-called sweeping operations.

The ink suction process puts the nozzles of the print head in surface contact with a cap, which is connected to a suction pump, to suck a specific amount of ink from the ink chambers of the head or ink supply path. Ink that has increased in viscosity inside the nozzles, and bubbles that have entered the ink path from the nozzles, are removed from the head by this process.

Sweeping processes use a flexible blade made, for example, by laminating together two different materials such as felt and rubber. During cleaning, this flexible blade is projected into the path of print head movement so that an edge of the blade wipes ink, paper dust, and other foreign matter from the nozzle surface as the print head moves. Because the surface of the flexible blade contacting the nozzle surface differs according to the direction of print head movement, the cleaning effect on the head differs according to the differences in the blade material. For example, the blade surface made of felt has higher contact resistance as it moves against the nozzle surface and greater ink absorbency compared with the rubber blade surface. It therefore acts to wipe away foreign material on the nozzle surface, and therefore has a good cleaning effect. Due to the differences in their cleaning effects, sweeping the nozzle surface with a felt material is referred to below as a "rubbing" process, and sweeping the nozzle surface with a rubber material is referred to as a "wiping" process.

When the power supply to an ink jet or other type of printer is turned off and then on again, an initialization process is required to assure normal operation. One step of this initialization process is to transport the print head on a carriage to a home position. A cleaning process as described above is also performed in conjunction with returning the print head to the home position.

However, if there is a power failure or the power cord is accidentally unplugged, power supply to printer mechanisms will be cut off and operations that are in progress will be interrupted. If an initialization or cleaning process is in progress at the time the power supply to the printer is cut off, operation of all mechanisms involved with the cleaning process stops.

When power is next turned on to a conventional ink jet printer, a specific initialization operation is performed regardless of the printer status when power was previously turned off. If the printer is in the middle of a cleaning process at the time the power supply is cut off as noted above, a number of problems can occur as described below.

More specifically, if the power is cut off during an ink suction process, that is, while ink is being suctioned from the nozzles, ink that was pulled from inside the nozzles remains in the cap when the power is turned on again. If the print head is moved as part of the initialization process when power supply resumes, the nozzle surface is separated from the cap and any ink remaining inside the cap can spill into the printer. If the ink is electrically conductive, electrical circuits and components can also misoperate. If this happens immediately after ink suction ends and the pressure inside the cap is lower than the air pressure outside the cap, the sudden change in pressure when the cap is remove can drive air bubbles from the nozzles into the head. When this happens, the ink meniscus at the nozzle opening (ink ejection opening) may not be properly formed. This can prevent ink from being normally ejected from the nozzles, and thus degrades print quality.

In addition, if the power is cut off during a sweeping operation, that is, while the flexible blade is in contact with the nozzle surface, the print head stops with the flexible blade bent in the direction opposite the direction of relative movement between the blade and nozzle surface. When the power is then turned on again, the print head may move in the direction opposite that in which it was moving before it stopped because the initialization process is typically performed in a conventional ink jet printer regardless of the printer status when the power supply is turned off. In this case the print head moves against the curvature of the flexible blade, thus subjecting the blade and its means of support to an undesirable external force and accelerating wear and deterioration of the blade.

The blade also exerts excessive force on the nozzle surface in this case, and can damage the water resistant film formed on the nozzle surface. Friction between the flexible blade and nozzle surface also increases, and impedes print head movement.

OBJECTS OF THE INVENTION

With consideration for the aforementioned problems, an object of the present invention is therefore to enable an initialization process, possibly including a cleaning operation, to be performed normally when power is turned on again after the power supply is cut off due to a power failure or unplugging of the power supply cord when a cleaning process is in progress.

More specifically, an object of the present invention is to provide an ink jet printer and an initialization control method therefor whereby an appropriate initialization process can be performed according to the status of a print head cleaning process at the time the power supply was cut off when the power is next turned on again.

SUMMARY OF THE INVENTION

To achieve the above object, an ink jet printer according to the present invention comprises an ink jet head having a nozzle for ejecting ink; a cleaner or cleaning means for cleaning said ink jet head; an initialization controller or control means for initializing the ink jet printer when power supply starts; a power interruption detector or detecting means for detecting interruption of power supply to the printer; an operating status memory or storage means for storing a current operating status of the cleaning means when the power interruption detecting means detects interruption of the power supply; and an operation selector or selecting means for selecting an operation to be performed by the initialization control means based on the operating status of the cleaning means stored in the operating status storage means.

The cleaning means preferably has a sweeper or sweeping means for sweeping a surface of the ink jet head, specifically the surface to which the nozzles are disposed (referred to hereafter as the nozzle surface). In this case, the operating status storage means stores a status indicative of whether the sweeping means is operating.

Further preferably, the sweeping means comprises a sweeping member for contacting and sweeping the nozzle surface, and a sweeping member driver or drive means for moving the sweeping member in a first direction and a second direction relative to the nozzle surface. In this case, the operating status storage means stores whether the sweeping member is being driven in the first or second direction by the sweeping member drive means when the sweeping means is operating.

Yet further preferably, the operation selecting means selects as the initial direction of movement in which the sweeping member is driven by the sweeping member drive means the first direction when the direction of sweeping member movement stored by the operating status storage means is the first direction, and the second direction when the direction of sweeping member movement stored by the operating status storage means is the second direction.

Yet further preferably, the cleaning means has a vacuum or suction means for sucking ink from a nozzle; and the operating status storage means stores a status indicative of whether the suction means is operating.

In this case, the suction means has: a cap for covering the nozzle surface of the ink jet head and forming a space isolated from outside air; a cap mechanism or moving means for moving the cap relative to the nozzle surface and positioning the cap to a first position whereat the cap covers the nozzle surface, or a second position whereat the cap does not cover the nozzle surface; a vent or a ventilation means openably disposed, and connecting the space formed by the cap to outside air when the ventilation means is open; and a pump connected to the cap for sucking through the cap air and ink inside said cap. The operating status storage means in this case stores a first suction means operating status or a second suction means operating status when the suction means is operating. The first suction means operating status indicates that a first suction process has started; this first suction process operates the pump when the ventilation means is closed. The second suction means operating status indicates that a second suction process has not ended; this second suction process operates the pump when the ventilation means is open.

The present invention is not limited to an ink jet or other printer, and can also be achieved effectively as an initialization control method for a printer. The method of the invention is also particularly suitable to an ink jet printer used in conjunction with a computer, and to initialization control of the computer. The invention can therefore also be achieved by a general purpose processor or computer executing software stored on a computer-readable data storage medium.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

FIG. 12 is a flow chart of an initialization process when power is turned on;

DESCRIPTION OF THE PREFERRED EMBODIMENTS

Figure 1:
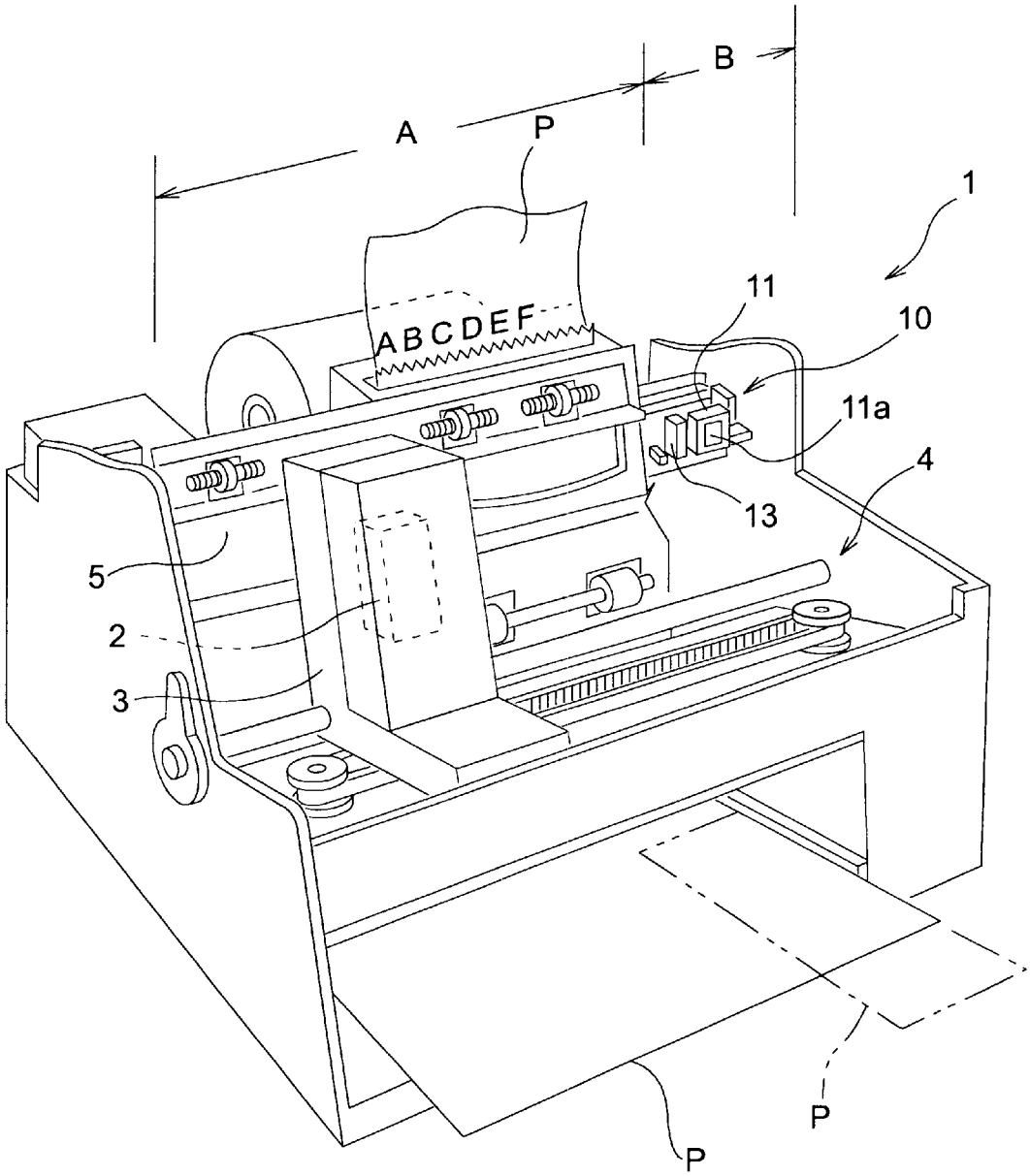
FIG. 1 is an external perspective view showing an ink jet printer according to the present invention with the top cover removed.

A first embodiment of the present invention is described below with reference to the accompanying drawings. FIG. 1 is an external perspective view showing an ink jet printer according to the present invention with the top cover thereof removed. The ink jet printer 1 shown in the figure is a POS printer that is remotely controlled by a host computer for printing to checks and other cut-sheet forms and roll paper (paper P below) for receipts, for example. It will be obvious from the following description that the present invention can be readily adapted to various types of ink jet printers having a cleaning means for the print head as described more fully below.

Referring to the figure, ink jet printer 1 can transport a carriage 3, on which a print head 2 is mounted, in a direction crossing the direction of recording medium or paper P by means of a transportation mechanism 4, in the same manner as other common printers. The print head 2 can be moved freely relative to the direction of carriage 3 movement in an area for printing to the paper P, that is, print area A, and a standby area B adjacent to the right side of print area A.

A platen 5 is disposed in the print area A opposite the direction of print head movement. The paper P is advanced to a gap between this platen 5 and print head 2 by means of a paper P transportation mechanism not shown in the figures, and ink drops are ejected onto the paper P in conjunction with controlled carriage 3 movement. Text and other print images are gradually formed by a dot matrix of ink drops on the paper P based on the timing of correlated carriage 3 movement, paper P transportation, and ink drop ejection operations.

The standby area B is a resting area for the print head 2 when printing is not in progress. Ink jet printer 1 has a maintenance unit or cleaner 10 for maintaining and cleaning print head 2 disposed in standby area B.

Figure 2:
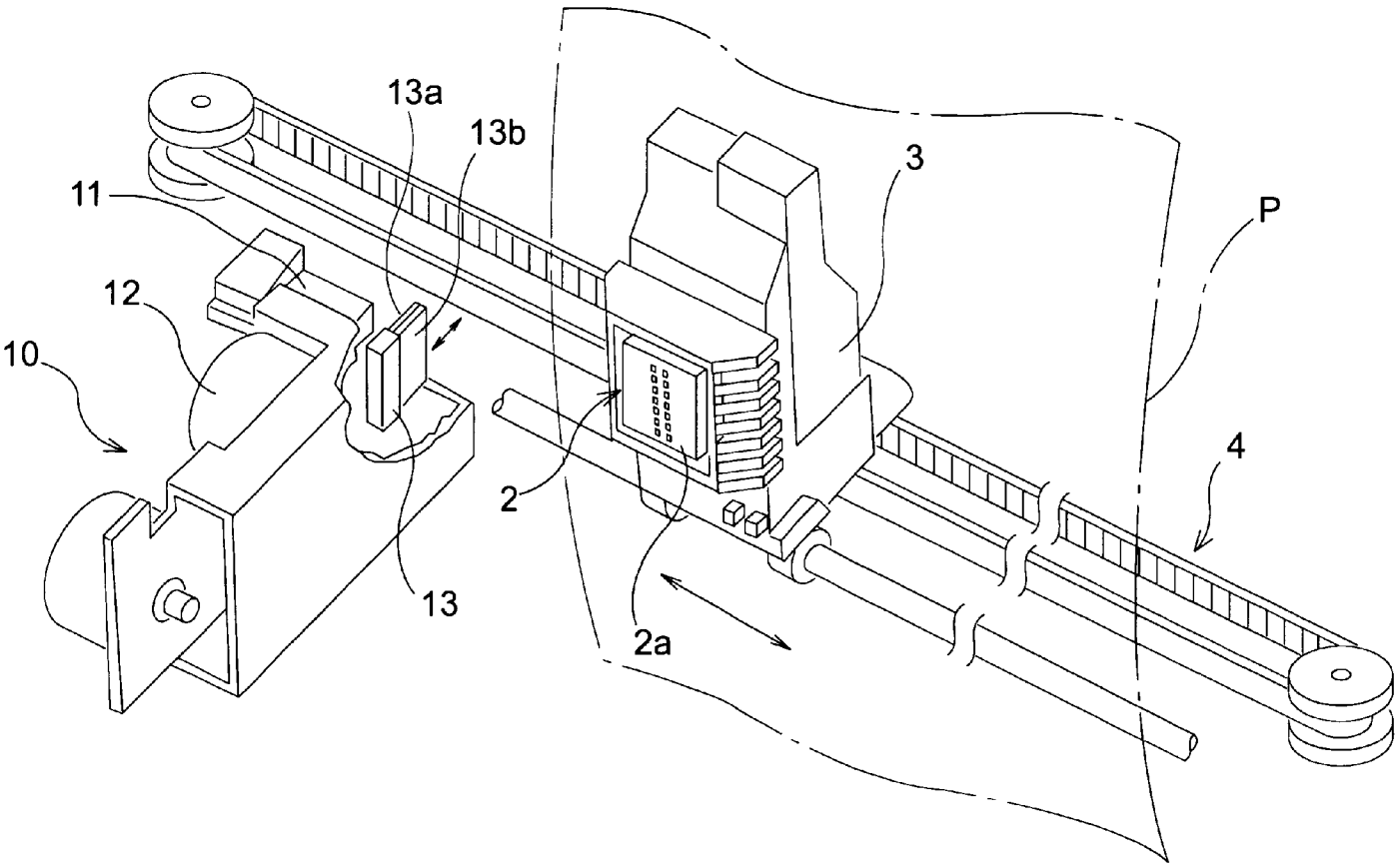
FIG. 2 is a perspective view of major parts of the ink jet printer shown in FIG. 1 in the area of standby area B.

FIG. 2 is a perspective view showing major components of an ink jet printer 1 in the area of the above-noted standby area B. It should be noted that these major components are shown from the side viewed opposite to that in FIG. 1. The configuration and operation of the maintenance unit 10 is further described below with reference to FIG. 2. The maintenance unit 10 comprises a cap part 11 for preventing the nozzles of the print head 2 from drying, a vacuum or an ink suction pump 12 for sucking ink from the nozzles, and a flexible blade 13 for wiping soiling from the nozzle surface.

As will be known from FIG. 1, the cap part 11 is open on the side thereof opposing nozzle surface 2*a* of the print head 2, and the inside of this opening is filled with felt or other ink absorbing material 11*a*. The nozzle surface 2*a* is maintained in a desirable condition by capping the nozzle surface 2*a* with cap part 11 such that nozzle surface 2*a* of print head 2 contacts the cap part 11. That is, capping the nozzle surface 2*a* isolates the nozzles, and thus prevents a rise in the viscosity of ink around the nozzles as a result of evaporation, and prevents such problems as a recession of the ink meniscus. Cap part 11 is moved into position by a cap mechanism.

The ink suction pump 12 is connected to the cap part 11 through which it performs an ink suction process, that is, opens part of the cap, sucks ink from the print head 2 in contact with cap part 11, and removes ink that has collected in the ink absorbing material 11*a*. This ink suction process removes bubbles from the nozzles and removes ink that has increased in viscosity around the nozzles. The flexible blade 13 moves in and out of the path of the print head 2, and functions by passing the print head 2 across the flexible blade 13 when the blade is extended. That is, when the print head 2 is moved with the flexible blade 13 extended forward, the edge of the flexible blade 13 contacts the nozzle surface 2*a*. This causes the flexible blade 13 to curve as a result of its flexibility as the edge of the flexible blade 13 wipes increased viscosity ink, paper dust, and other foreign matter from the nozzle surface 2*a*.

Figure 3A:
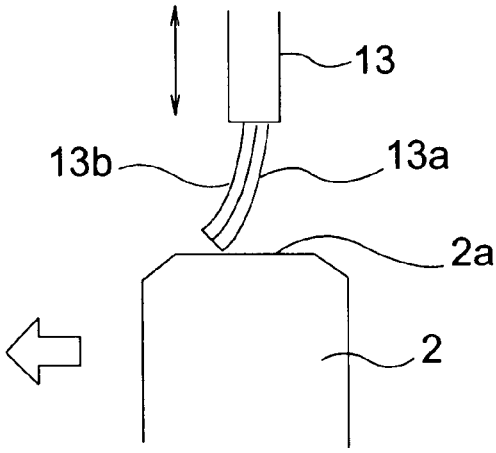
FIGS. 3A and 3B is are typical plan views showing the action of flexible blade 13.
Figure 3B:
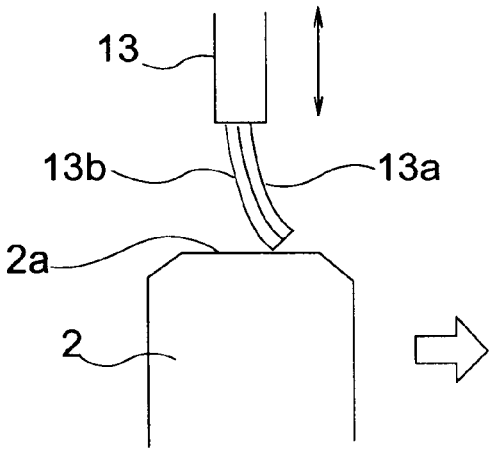

Turning to FIGS. 3A and 3B the flexible blade 13 is formed by laminating a rubber member 13*a* with a felt member 13*b* such that different cleaning effects can be achieved depending on the direction of print head 2 movement. As shown in FIG. 3A, for example, when the print head 2 is moved from right to left with respect to the flexible blade 13, that is, is moved to the print area A, the rubber member 13*a* contacts the nozzle surface 2*a*. This accomplishes a relatively light wiping-like cleaning of the nozzle surface. This process is therefore referred to as "wiping."

When the print head 2 moves from left to right relative to the flexible blade 13, as shown in FIG. 3B, however, that is, moves toward the side wall of the printer, the felt member 13*b* contacts the nozzle surface 2*a*. This results in a relatively strong cleaning of the nozzle surface whereby foreign matter is rubbed from the surface. This process is therefore referred to as "rubbing."

It is to be noted that these rubbing and wiping processes are collectively referred to herein as "sweeping" processes.

Figure 4:
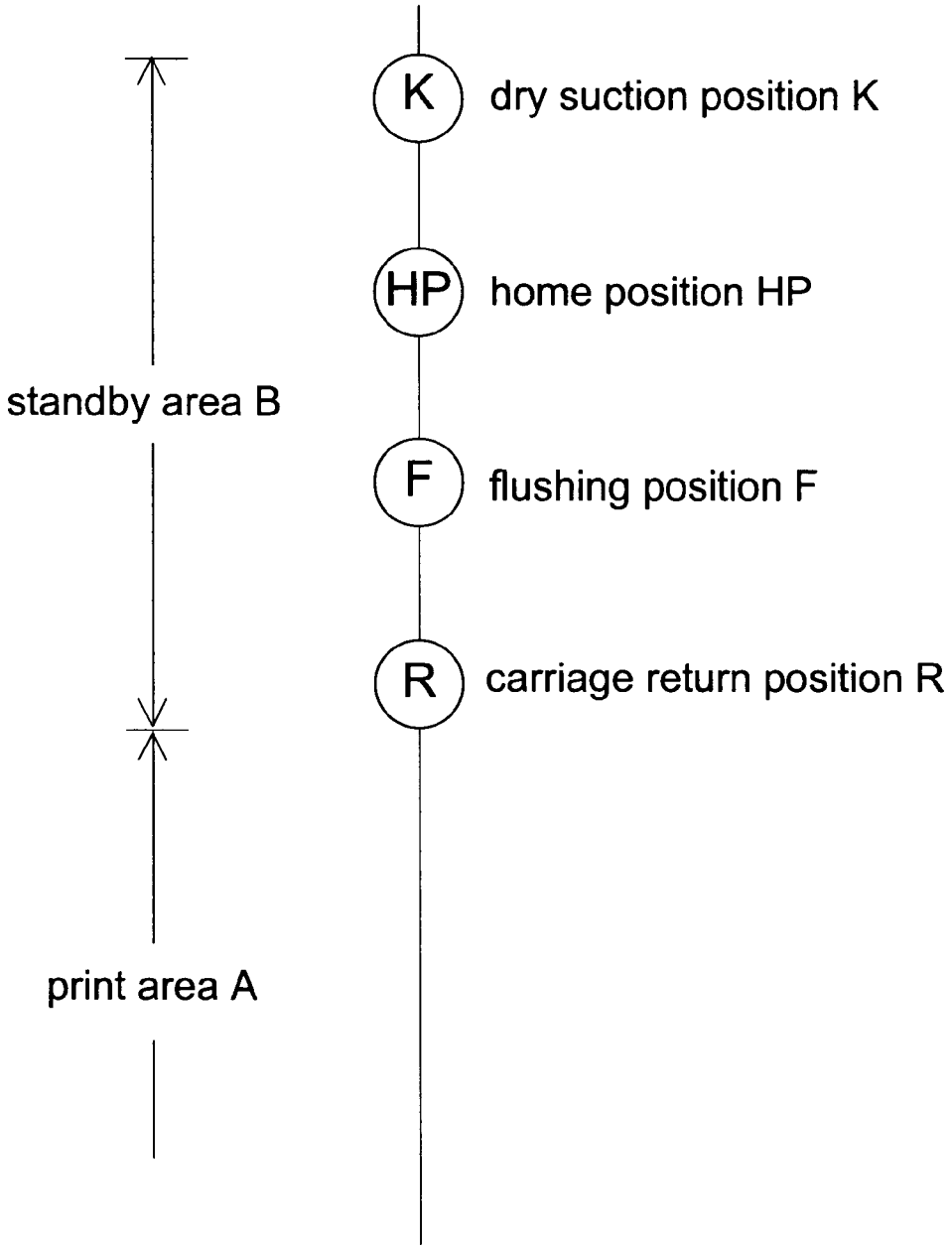
FIG. 4 is an explanatory diagram showing carriage stopping positions.

FIG. 4 is used to describe the stopping positions of carriage 3 and print head 2. As shown in the figure, print head 2 is controlled to stop at a plurality of stopping positions in the standby area B, that is, at carriage return position R, flushing position F, home position HP, and dry suction position K. Print head 2 is maintained and cleaned by the maintenance unit 10 at these specific positions.

It is to be noted that dry suction as used herein is a process whereby the nozzle surface is sealed by the cap, a vent or ventilation hole in the cap is opened, and the ink suction pump 12 is driven to suction and remove ink that has collected inside the cap. The dry suction position K is described further below.

The carriage return position R is where carriage 3 movement starts and ends in the print head 2 wiping and rubbing processes. That is, carriage 3 is first set to the dry suction position K for the wiping process, and is moved therefrom toward the print area A and stopped at the carriage return position R. For the rubbing process, carriage 3 is first positioned at the carriage return position R, and is then moved therefrom toward the printer side wall and stopped at the dry suction position K.

The flushing position F is used for flushing ink from the nozzles of the print head 2 by ejecting ink to expel increased viscosity ink from the nozzles. The cap part 11 is opposite the print head 2 with a gap therebetween at this time so that the expelled ink is absorbed by the ink absorbing material 11*a*. Note that the flexible blade 13 used for wiping and rubbing processes is extended into the path of the print head 2 near this flushing position F to clean the nozzle surface of the print head 2 as it passes the flushing position F.

The home position HP is the default position of the carriage 3. The carriage 3 is moved to the home position HP when the power is turned on and other initialization processes are performed, and the ink jet printer 1 then waits for a print command. The nozzle surface of print head 2 is capped by the cap part 11 when in the home position HP. In this preferred embodiment of the present invention, the home position HP also functions as the ink suction position. That is, the ink suction pump 12 is driven when the carriage 3 is in the home position HP to accomplish the ink suction process.

The dry suction position K is used for dry suction process. In this dry suction process, ink that has collected in the ink absorbing material 11*a* of the cap part 11 is expelled without sucking ink from the print head 2. Moving the carriage 3 to the dry suction position K opens a valve for introducing air to the cap part 11 containing ink absorbing material 11*a* therein. The print head 2 is thus capped when in the dry suction position K as it is in the home position HP, but air can be introduced to the cap part 11 by opening this valve so that only the ink collected in the space formed between the cap part 11 and nozzle surface is suctioned and removed through the ink absorbing material 11*a* without pulling more ink from the nozzles of the print head.

Cleaning processes that can be performed by an ink jet printer 1 thus comprised are described next below. This ink jet printer 1 can perform two types of cleaning processes: relatively frequent, low level cleaning (below referred to as cleaning level 1), and high level cleaning (cleaning level 2 below) that is performed as necessary.

JP application No 08-143348, filed on Jun. 5, 1996, entitled Ink Jet Printer, JP application No 11-41678 filed on Feb. 19, 1999, entitled Ink Jet Recording Apparatus and Control Method For The Same, and JP application No 11-198995 filed on Jul. 7, 1999, entitled Ink Jet Recording Apparatus, describe mechanisms for performing ink suction and dry suction operations. The contents of each of which are incorporated herein by reference.

Figure 16:
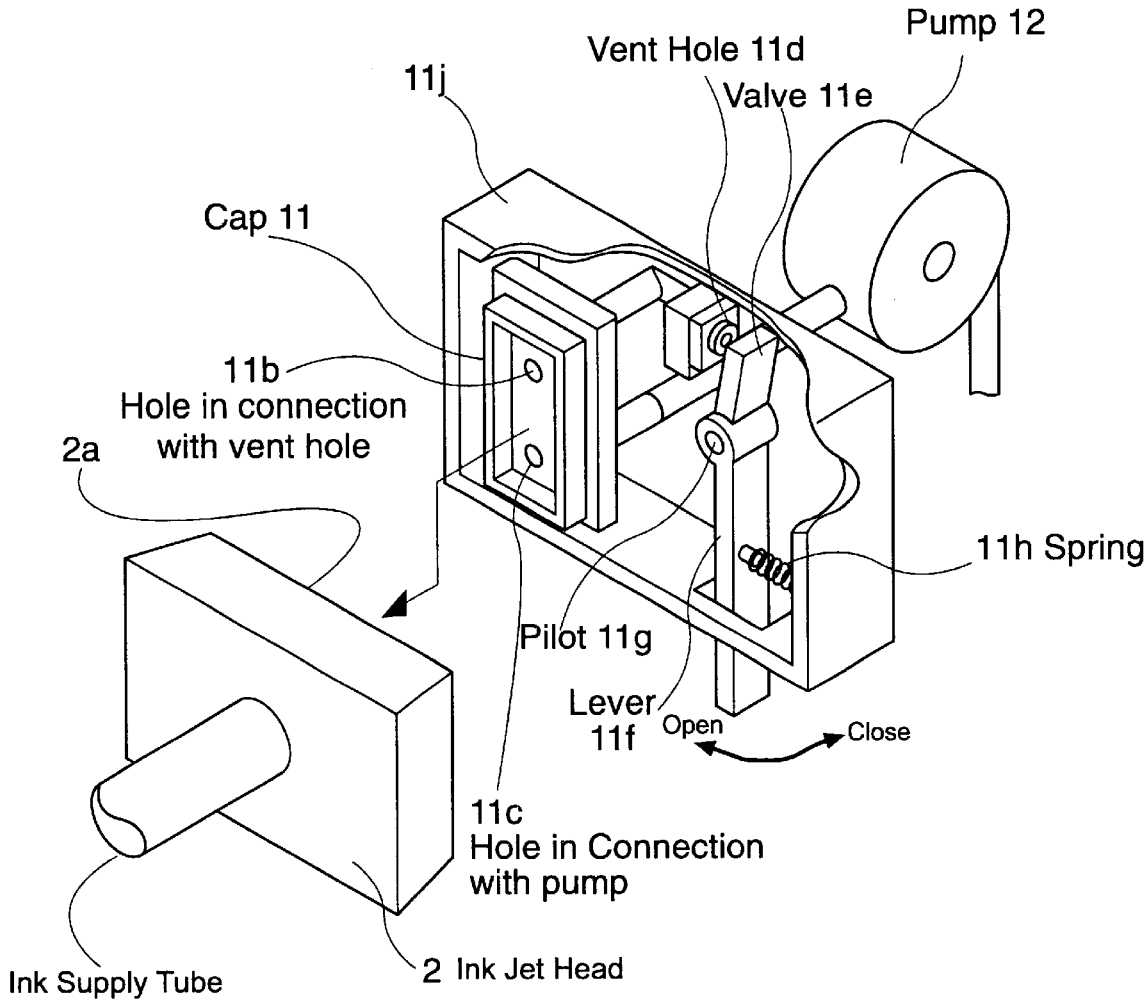
FIG. 16 is a perspective view showing a valve system attached in the vicinity of a cap.
Figure 17A:
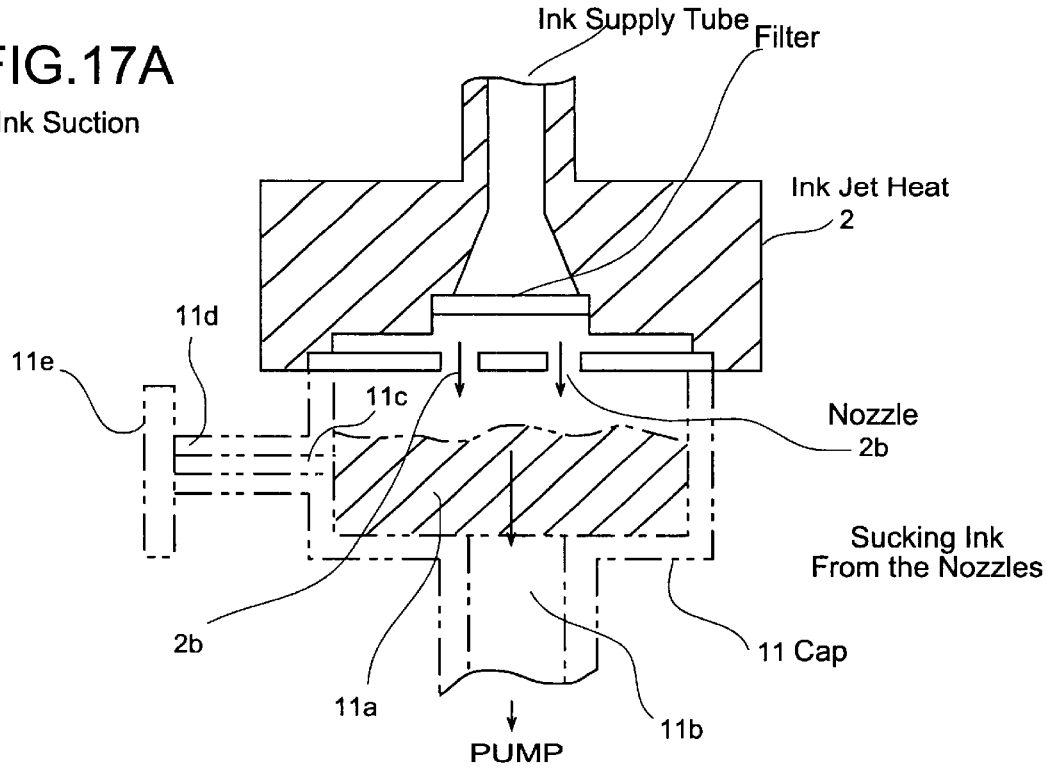
FIG. 17A is an illustration for the explanation of the operation of the system shown in FIG. 16 during ink suction.
Figure 17B:
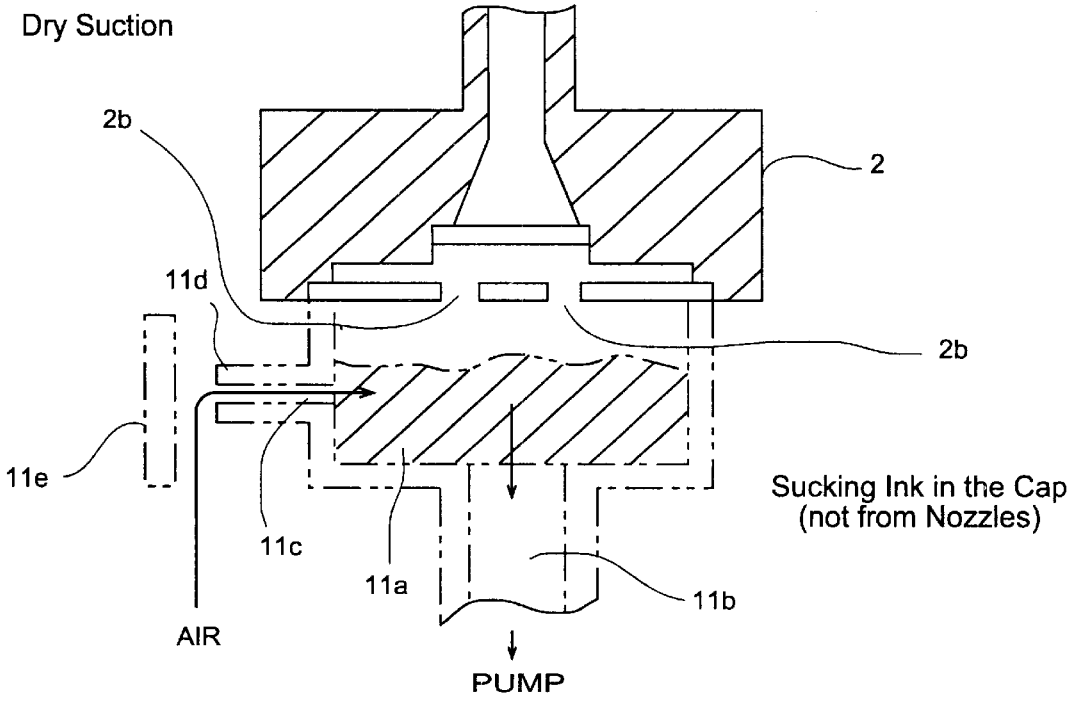
FIG. 17B is an illustration for the explanation of the operation of the system during dry suction.

A mechanism for performing ink suction and dry suction operations will now be described with reference to FIGS. 16, 17A, and 17B. FIG. 16 is a perspective view showing a valve system attached in the vicinity of a cap; FIG. 17A is an illustration for the explanation of the operation of the system shown in FIG. 16 during ink suction; and FIG. 17B is an illustration for the explanation of the operation of the system during dry suction.

As shown in these drawings, a hole 11*c* connected to a pump 12, and a hole 11*b* connected to a vent hole 11*d* are formed in the inner wall of a cap part 11. A valve system is provided in the vicinity of the cap part 11. A lever 11*f* is attached to a cap holder 11*j* so as to be rotatable about a pivot 11*g*.

A valve 11*e* is formed on one end of the lever 11*f*, and the vent hole 11*d* is opened and closed by the valve 11*e* with the rotation of the lever 11*f*. A spring 11*h* is attached at a midpoint of the lever 11*f*, and the lever 11*f* is urged by the spring 11*h* in a direction to close the vent hole 11*d*. By pushing the other end of the lever 11*f* clockwise against a force of the spring 11*f*, the valve 11*e* is opened.

When a carriage 3 is in a home position HP, a nozzle surface of a print head 2 is capped by the cap part 11, as shown in FIG. 17A, and the vent hole 11*d* is closed by the valve 11*e*. When the pump 12 is actuated in this state, ink in the print head 2 is sucked into the cap part 11 from the nozzle 2*b*.

When the carriage 3 moves to a dry suction position K, the valve 11*e* is opened while the nozzle surface of the print head 2 is being capped by the cap part 11, and the vent hole 11*d* is opened to the outside air. When the pump 12 is actuated in this state, only the ink gathered in an ink absorber 11*a* in the cap part 11 is discharged toward the pump 12 without sucking the ink from the print head 2.

While it is not shown in the drawings, in order to move the cap part 11 to a position to cap the nozzle surface 2*a* of the print head 2, and to a position apart from the nozzle surface 2*a*, a cam mechanism for converting the movement of the carriage 3 into the movement of the cap part 11, such as a mechanism disclosed in, for example, Japanese Unexamined Patent Publication No. 9-323404, may be adopted, which is incorporated herein by reference. In addition, a mechanism using a driving force of a motor may be adopted so as to move the cap part 11.

Similarly, the movement of the carriage 3 may be utilized, or a mechanism using a driving force of a motor may be adopted so as to open and close the valve 11*e*.

Figure 5:
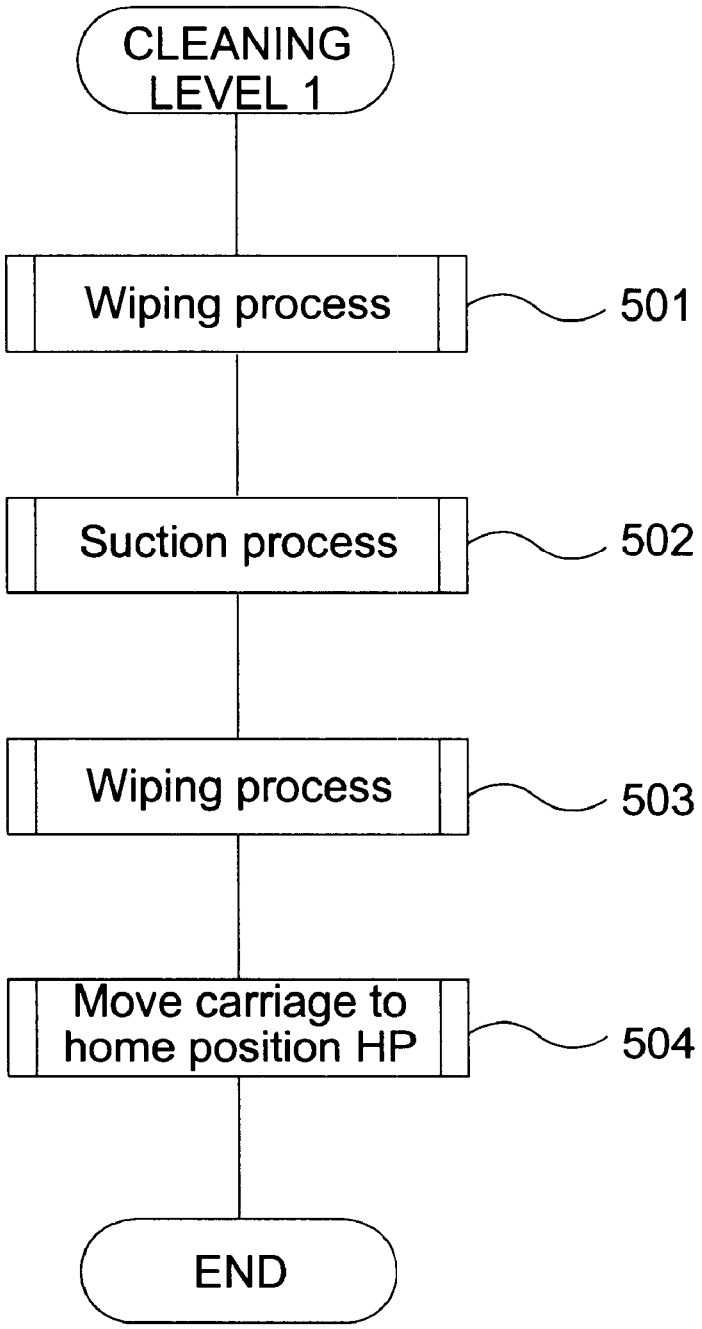
FIG. 5 is a flow chart of a cleaning level 1 process.
Figure 6:
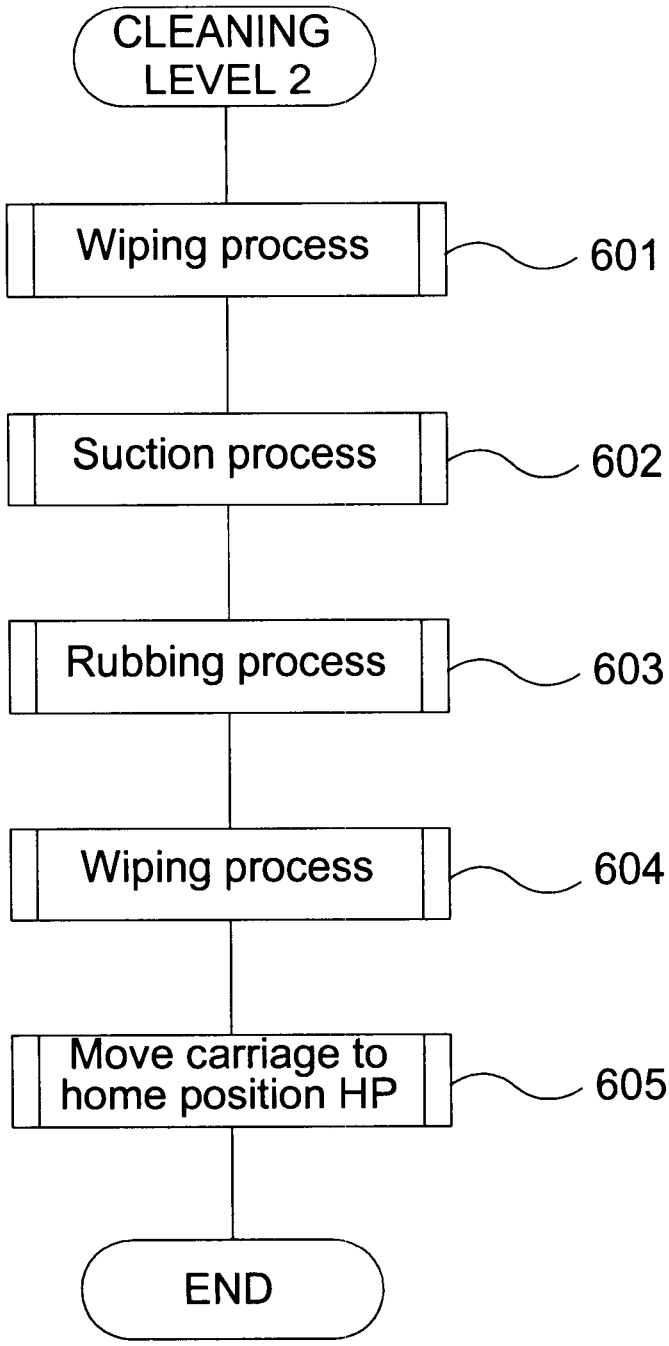
FIG. 6 is a flow chart of a cleaning level 2 process.

FIG. 5 is a flow chart of the process applied for cleaning level 1, and FIG. 6 is a flow chart of the process applied for cleaning level 2.

As shown in FIG. 5, cleaning level 1 combines a wiping process and suction process. Cleaning level 1 starts with a wiping process (501), followed by a suction process (502), followed by another wiping process (503) and then returning the carriage to the home position (504).

As shown in FIG. 6, cleaning level 2 adds cleaning with a rubbing process to the wiping process and suction process. Cleaning level 2 also starts with a wiping process (601), followed by a suction process (602). Note that the suction process in step 602 can take more time for ink suction than the suction process in cleaning level 1. Cleaning level 2 also precedes the wiping process (604) with a rubbing process (603). The wiping process in step 603 of cleaning level 2 uses more force to clean print head 2 than is used in cleaning level 1. A wiping process (604) is then performed after step 603, the carriage is returned to the home position HP (605), and the process ends.

Whether cleaning level 1 or cleaning level 2 is applied can be determined with consideration given to the print volume and time elapsed since the previous cleaning operation. An ink jet printer 1 described below comprises an EEPROM for storing the time elapsed and print volume since the previous cleaning operation. The content of this EEPROM is read before cleaning begins to select the cleaning level to be used.

Figure 7:
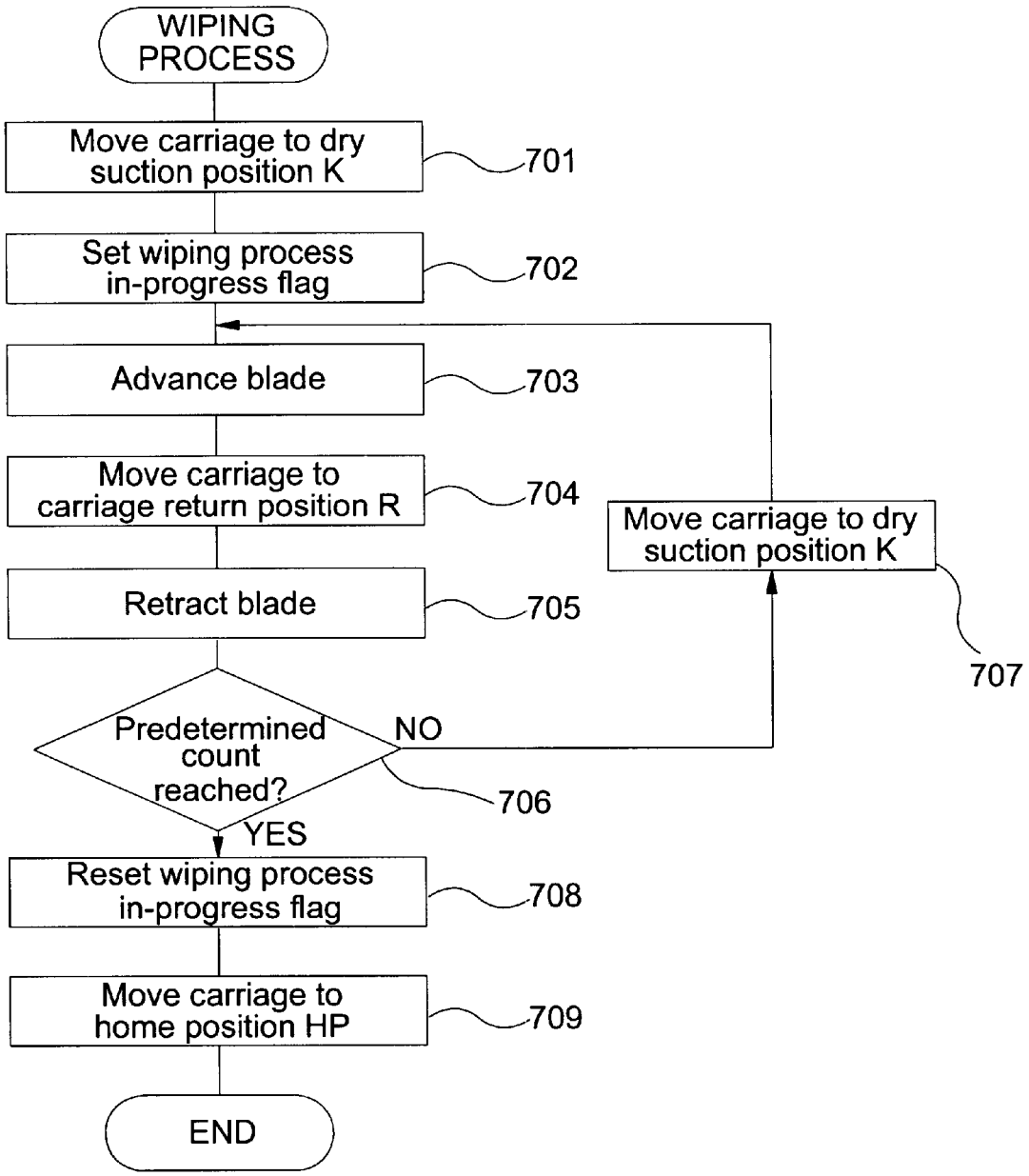
FIG. 7 is a flow chart of specific steps in a wiping process.
Figure 8:
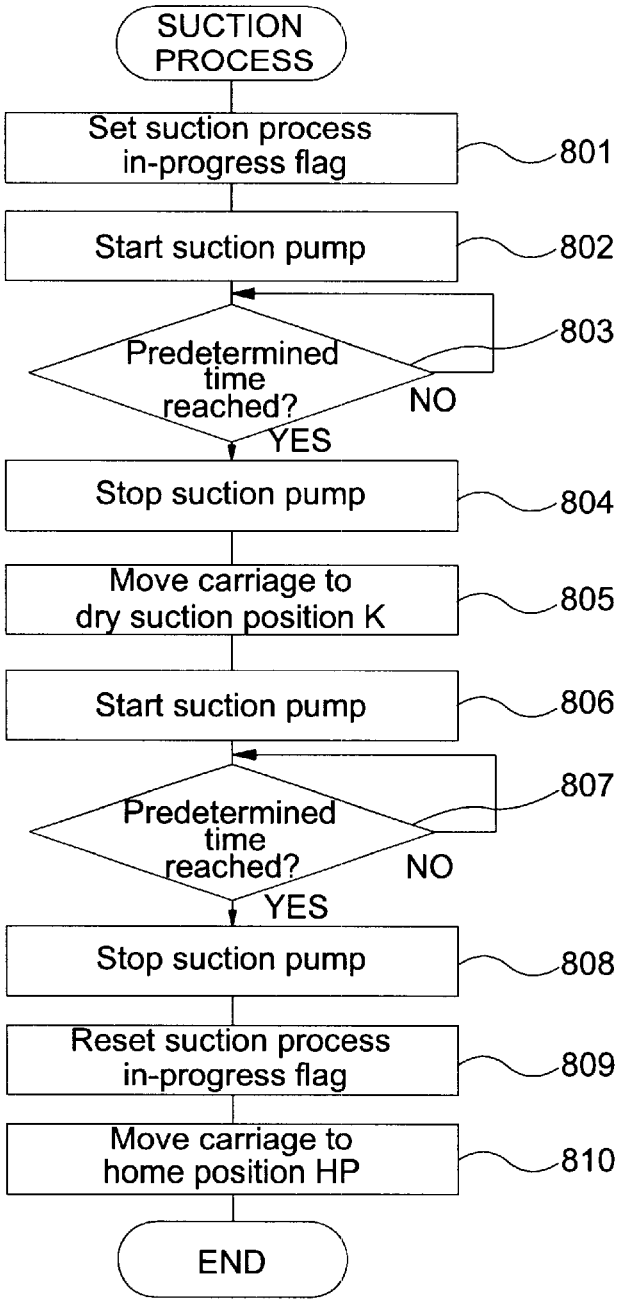
FIG. 8 is a flow chart of specific steps in a suction process.
Figure 9:
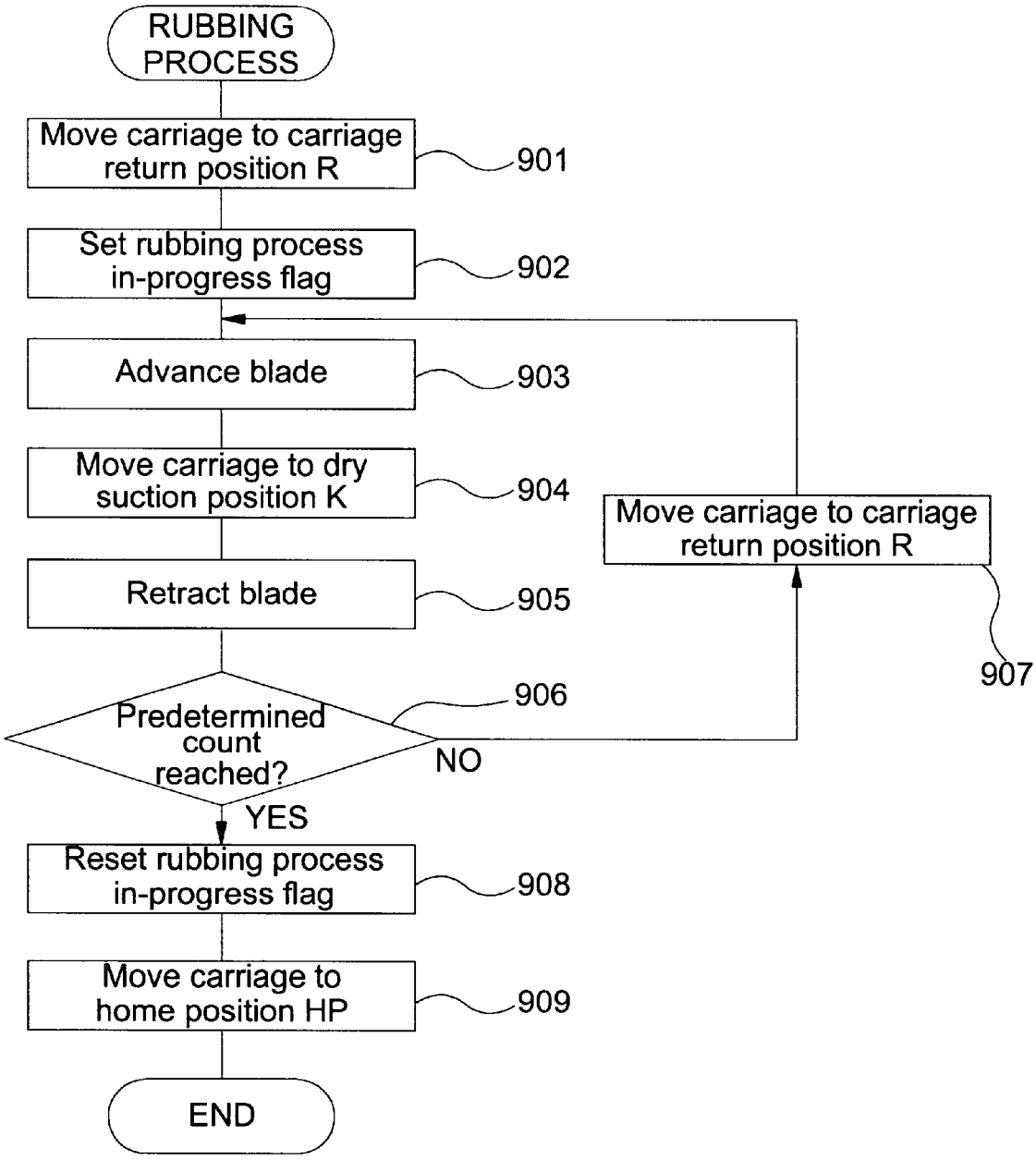
FIG. 9 is a flow chart of specific steps in a rubbing process.

FIG. 7 to FIG. 9 are flow charts showing the specific procedures used for the wiping process, suction process, and rubbing process performed in the above-noted cleaning operations. It is to be noted that a printer according to the present invention sets a flag indicative of the cleaning process in progress whenever the printer is performing one of these operations.

FIG. 7 is a flow chart of the wiping process performed in steps 501 and 503 in FIG. 5, and steps 601 and 604 in FIG. 6. When the printer begins the wiping process step of a cleaning process, the carriage 3 is moved to the dry suction position K shown in FIG. 4 (701), and a flag is then set (that is, a data bit allocated to the wiping process is set to 1) (702) to indicate that a wiping process is in progress. The flexible blade 13 is then advanced into the path of the print head 2 (703), and the carriage 3 is moved to the carriage return position R. When the carriage 3 thus moves, the print head 2 contacts the advanced flexible blade 13, and the nozzle surface 2*a* is thus cleaned by the flexible blade 13. In the next step the flexible blade 13 is retracted (705), and it is determined whether carriage movement, that is, cleaning the nozzle surface 2*a*, has reached a specific count (706). If the process has not reached this specific count, the carriage 3 is returned to the dry suction position K (707), and steps 703 to 705 are repeated until this specific count is reached. When the process reaches this specific count, the flag indicating that the wiping process is in progress is reset (that is, the data bit is set to 0) (708), the carriage 3 is moved to the home position HP (709), and the wiping process ends.

FIG. 8 is a flow chart of the suction process performed in step 502 in FIG. 5, and step 602 in FIG. 6. The carriage 3 is moved to the home position HP by the last step (709 in FIG. 7) of the wiping process performed before the suction process. The print head 2 is capped in the home position HP, and the suction process described below is performed with the print head 2 thus capped.

When the printer starts the suction process step of a cleaning process, a flag is then set (that is, a data bit allocated to the suction process is set to 1) (801) to indicate that a suction process is in progress. The ink suction pump 12 is then started, run for a specific length of time, and then stopped (802 to 804).

Operations then pauses for a specific time to allow the pressure inside the cap to equalize with the ambient air pressure. This is to avoid driving air bubbles through the nozzles into the print head as a result of a sudden rise in pressure inside the cap if the cap is opened when the ambient air pressure is higher than the pressure inside the cap.

Next, the carriage 3 is moved to the dry suction position K shown in FIG. 4 (805), and as noted above the ink suction pump 12 is again started, run, and stopped after running for a specific length of time (806 to 808). As previously described, a valve for cap part 11 is opened when the carriage 3 moves to the dry suction position K, and dry suction, that is, expelling ink from the ink absorbing material 11*a*, is then accomplished. The flag indicating that a suction process is in progress is then reset (809), the carriage 3 is returned to the home position HP (810), and the suction process ends.

FIG. 9 is a flow chart of the rubbing process performed in step 603 in FIG. 6. This rubbing process basically performs a process in which the carriage 3 travels in the direction opposite that used in the wiping process. When the printer begins the rubbing process step of a cleaning process, the carriage 3 is moved to the carriage return position R shown in FIG. 4 (901), and a flag is then set (that is, a data bit allocated to the rubbing process is set to 1) (902) to indicate that a rubbing process is in progress. The flexible blade 13 is then advanced into the path of the print head 2 (903), and the carriage 3 is then moved to the dry suction position K. When the carriage 3 thus moves, the print head 2 contacts the advanced flexible blade 13, and the nozzle surface 2*a* is thus cleaned by the flexible blade 13. In the next step the flexible blade 13 is retracted (905), and it is determined whether carriage movement, that is, cleaning the nozzle surface 2*a*, has reached a specific count (906). If the process has not reached this specific count, the carriage 3 is returned to the carriage return position R (907), and steps 903 to 905 are repeated until this specific count is reached. When the process reaches this specific count, the flag indicating that the rubbing process is in progress is reset (that is, the data bit is set to 0) (908), the carriage 3 is moved to the home position HP (909), and the rubbing process ends.

Figure 10:
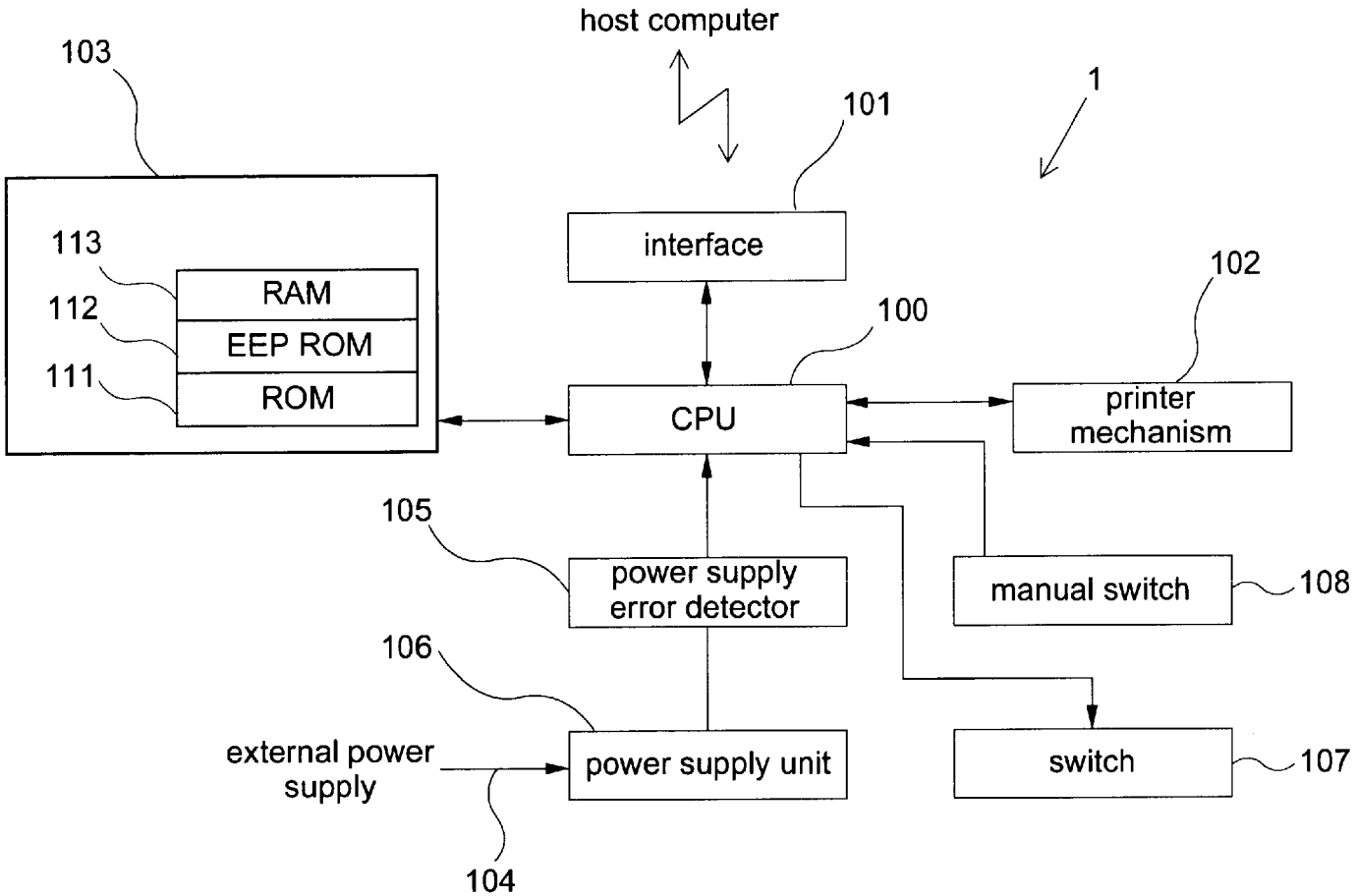
FIG. 10 is a block diagram relating to control of an ink jet printer according to the present invention.

Controlling operation of the ink jet printer 1, particularly control when the power supply is cut off and the power is then turned on, is described next. FIG. 10 is a block diagram related to controlling an ink jet printer according to the present invention. Referring to the figure, CPU 100 is the controller for overall control of the ink jet printer 1, and controls communication with a host computer via interface 101, operation of the printer mechanism 102, which includes the cleaning mechanism, monitoring various switches and sensors on the printer, and other control processes. Memory unit 103 comprises a computer-readable medium such as ROM 111 for storing the various control programs run by the CPU 100, RAM 113 as main memory for temporarily storing programs read from ROM and data for processing by the CPU 100, and an operating status memory or EEPROM 112 for storing various printer status information, such as the ink cartridge status, cover status, counter values, cleaning status, printer operating time and other timing information. Of course as understood by one of ordinary skill in the art, the computer-readable medium may comprise magnetic storage devices, optical storage devices, electrical storage devices or the like.

It is to be noted that the control program to be run by the CPU 100 is stored in the ROM of memory unit 103, but the invention shall not be so limited. More specifically, the control program can be loaded from a host device connected through interface 101, stored to internal RAM, and run from RAM. The control program can further be stored by the host device to various media, including a hard disk, floppy disk, optical disk, or other external or internal storage device. It can also be retrieved from a remote location via the Internet or other network.

As noted above, CPU 10 performs numerous functions and is comprised by an initialization controller to initialize the ink jet printer when a supply of power to the ink jet printer starts and an operation selector to select an operation to be performed by said initialization controller based on the current operating status of said cleaner stored in said operating status memory. Further details of the operation of CPU 10 are discussed herein below.

In conjunction with the present invention, EEPROM 112 stores the cleaning status of the print head 2 at the time the external power supply 104 to the printer is interrupted. More specifically, a different flag is set in EEPROM 112 according to whether the cleaning process in progress at the time the external power supply 104 is interrupted is the ink suction process, wiping process, or rubbing process, or whether no cleaning process is in progress. For example, three bits corresponding to the above-described processes are allocated for storing the current cleaning status, and the cleaning process status can be stored by setting one of these bits to 1 (all bits are set to 0 when no cleaning process is in progress).

Power supply error detector 105 detects the current or voltage of the external power supply 104 supplied through power supply unit 106, and notifies the CPU 100 when it becomes a level adversely affecting printer operation. The power supply error detector 105 thus detects when the external power supply 104 is cut off, such as due to a power failure or inadvertent disconnection of the power cord from the power outlet, and notifies the CPU 100. When the CPU 100 in a printer according to the present invention receives this detection signal from the power supply error detector 105, it stores the current cleaning status to EEPROM 112 of the memory unit 103 in the approximately 100 ms delay until power supply to the CPU 100 is completely cut off. When the external power supply 104 is cut off, the supply of power to the printer mechanism 102 is interrupted and any process being performed by the printer mechanism 102 stops. If the ink jet printer 1 is performing a cleaning process at this time, whether a wiping process, suction process, or rubbing process, the cleaning process will stop where it is when the power supply stops.

It is to be further noted that ink jet printer 1 further comprises a switch 107 for cutting off the power supply from power supply unit 106 based on a control signal from CPU 100, and such user-operable manual switches 108 as a power on/off switch, cleaning switch, and paper feed switch.

Figure 11:
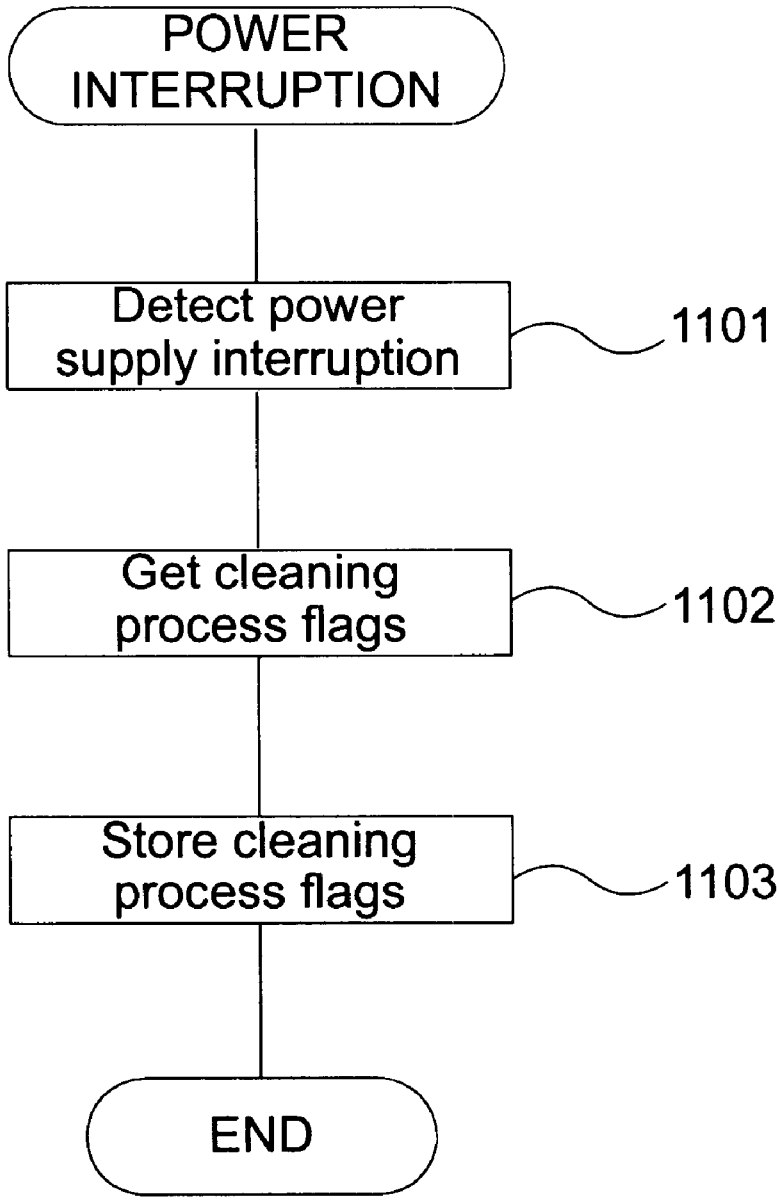
FIG. 11 is a flow chart of a process for when external power to the ink jet printer is cut off.

FIG. 11 is a flow chart of a process for when the external power supply 104 to the ink jet printer is interrupted as a result of a power failure or inadvertent disconnection of the power cord. The power supply error detector 105 detects when the external power supply 104 shown in FIG. 10 is interrupted (1101). When the CPU 100 receives this detection signal, it reads the cleaning status flag from main memory (1102), and writes the cleaning status to EEPROM (1103).

Figure 12:
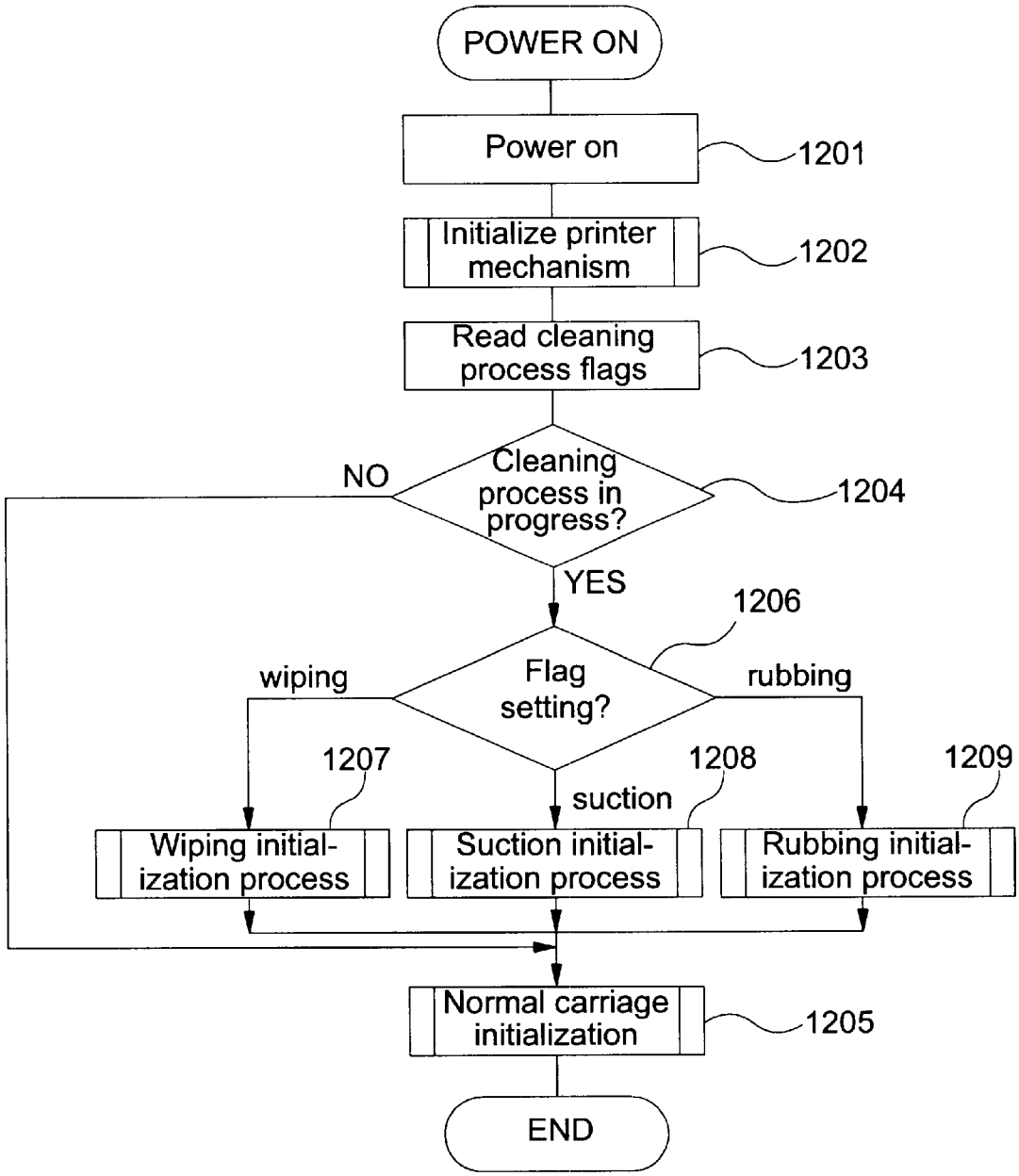

Printer initialization control when the user turns ink jet printer 1 power on is described next. FIG. 12 is a flow chart of the initialization process when power is turned on.

When the user operates a manual switch 108 shown in FIG. 10 to turn ink jet printer 1 power on (1201), the printer. mechanism 102 is initialized with an initialization process not including carriage 3 movement (1202). In other words, the paper feed mechanism for roll and slip forms, automatic paper cutter, and feed roller, for example, are initialized. The cleaning process status flag is then read from EEPROM 112 in memory unit 103, and the flag content is evaluated (1203). If none of the cleaning process progress flags are set, it is determined (1204) that either printer power was shut down normally the last time (that is, power supply was interrupted either by the user operating a manual switch or by a shutdown signal from the CPU 100), or a cleaning process was not in progress when the power supply was interrupted if the power supply was not normally interrupted, that is, the power supply was cut off due to a power failure or disconnection of the power cord. In this case carriage movement is initialized normally (1205). It is to be noted that moving the carriage 3 a specific number of steps to the print area A and returning it to the home position HP can be performed as part of the normal initialization process.

On the other hand, if one of the cleaning process progress flags is set, that is, the power supply was not normally shut down the last time due to a power failure or disconnection of the power cord and a cleaning process was in progress when the power was interrupted, an initialization process corresponding to the content of the set cleaning process flag is performed (1207, 1208, or 1209). More specifically, if step 1206 detects that a flag was set indicating that the wiping process was in progress the last time the power supply was interrupted, a wiping initialization process is performed (1207); if the flag indicating a suction process was in progress is set, a suction initialization process is performed (1208); if the flag indicating a rubbing process was in progress is set, a rubbing initialization process is performed (1209).

Figure 13:
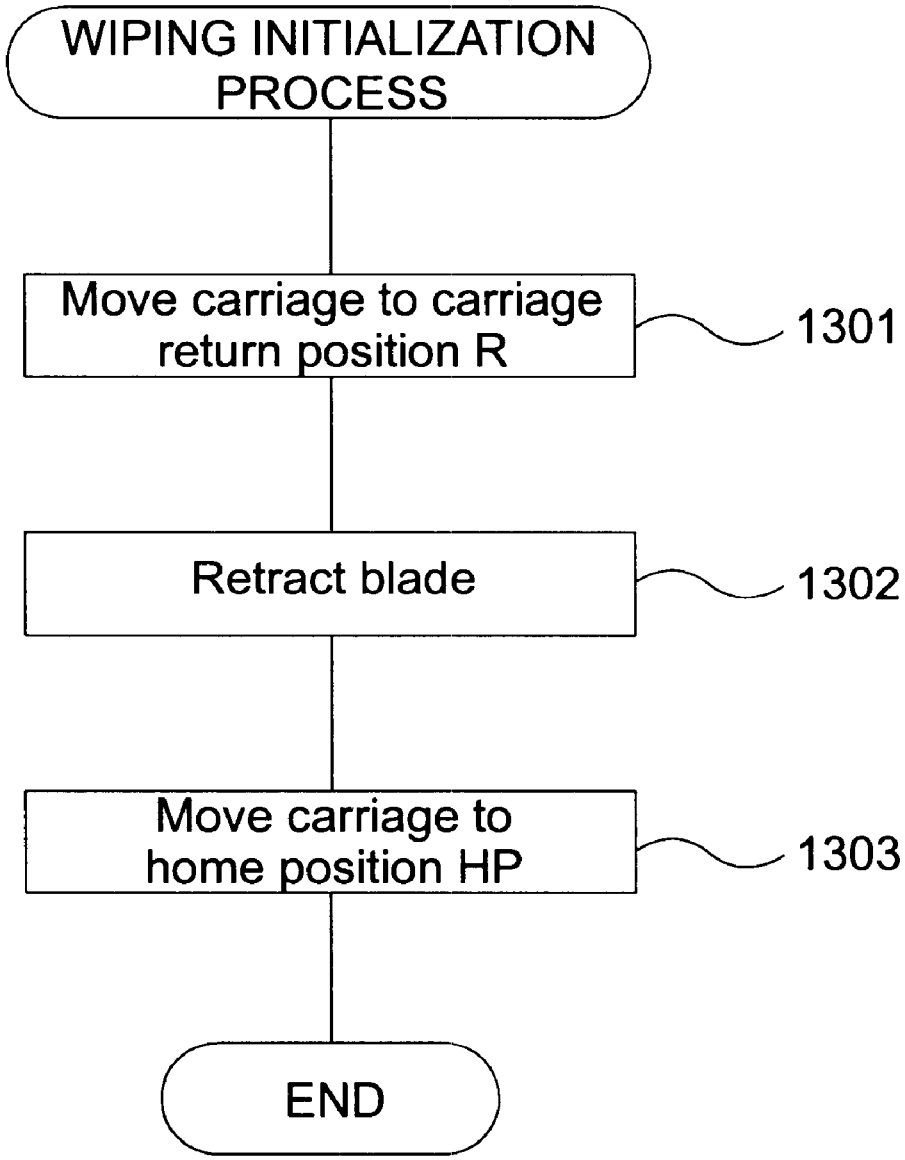
FIG. 13 is a flow chart of specific steps in the wiping initialization process shown in FIG. 12.
Figure 14:
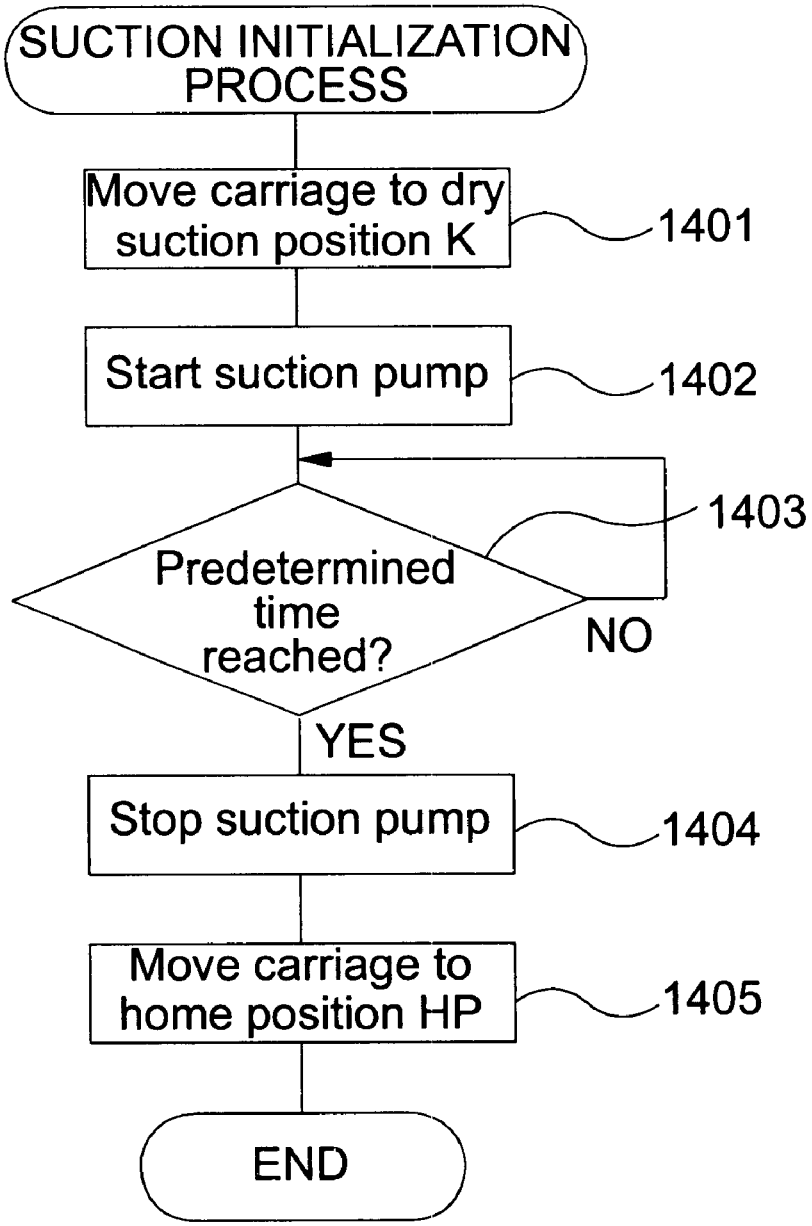
FIG. 14 is a flow chart of specific steps in the suction initialization process shown in FIG. 12.
Figure 15:
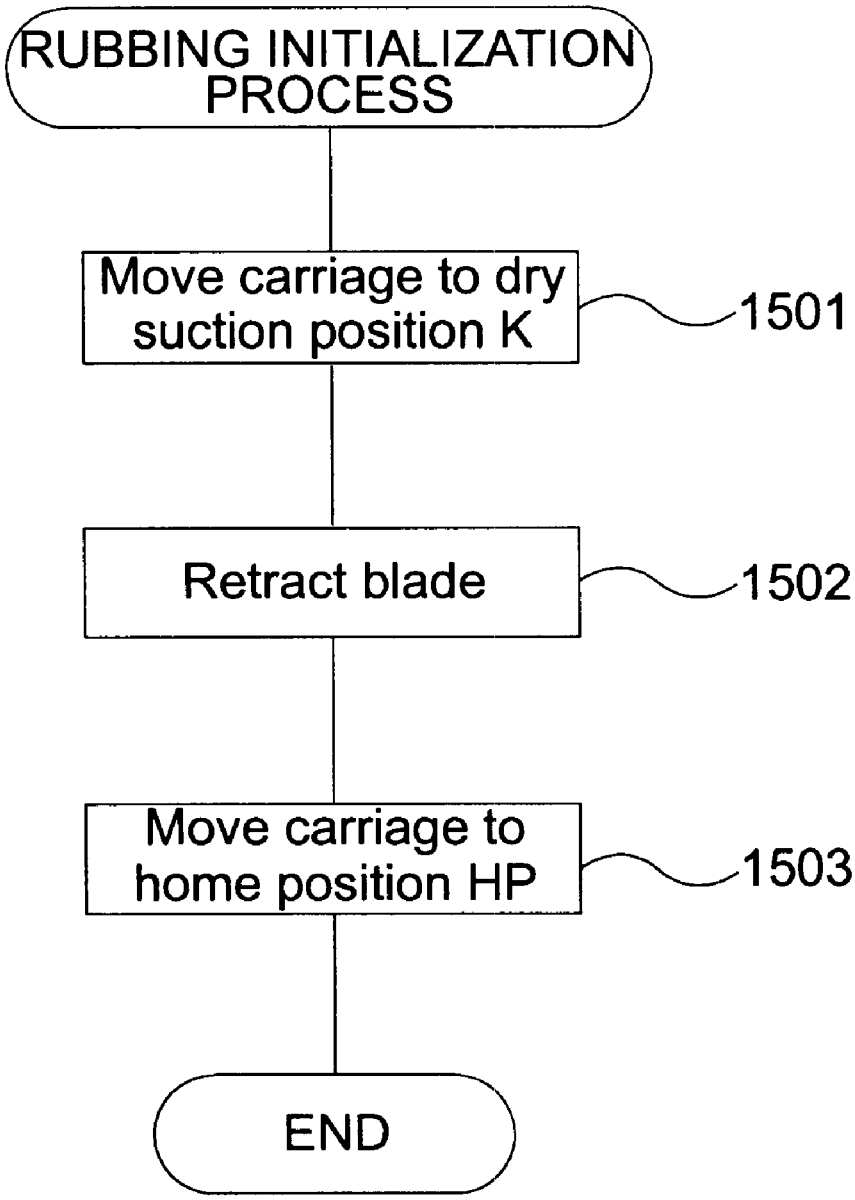
FIG. 15 is a flow chart of specific steps in the rubbing initialization process shown in FIG. 12.

FIG. 13 to FIG. 15 are flow charts of the steps performed in the wiping initialization process, suction initialization process, and rubbing initialization process. Various problems that can result from a cleaning process being performed when the power supply is suddenly cut off can be avoided by these initialization processes. As shown in FIG. 13, the first step in the wiping initialization process is moving the carriage 3 to the carriage return position R (1301). Next, the flexible blade 13 is retracted (or if the flexible blade is already retracted it is held in the retracted position), and finally the carriage 3 is moved to the home position HP to complete the process (1302, 1303).

If the power is cut off when the flexible blade 13 is wiping the nozzle surface 2*a* of print head 2 (step 704 in FIG. 7), the flexible blade 13 will be stopped curved against the nozzle surface 2*a*. If an appropriate initialization process is then not performed when the power is turned on and the carriage 3 returns directly to the home position HP, that is, is moved in a direction opposite the direction of carriage movement when the nozzle surface is being wiped, an inappropriate load will be applied to the flexible blade 13. This problem is avoided, however, by the wiping initialization process first moving the carriage 3 in the same direction in which the carriage 3 is moved for wiping.

If the cleaning process flag stored to EEPROM 112 indicates the suction process, the suction initialization process shown in FIG. 14 is performed. As shown in the figure, the first step in the suction initialization process is moving the carriage 3 to the dry suction position K (1401). The ink suction pump 12 is then run for a specific time and stopped to accomplish a dry suction process (1402 to 1404). The carriage 3 is then moved to the home position HP (1405), and the process ends.

Even if the power is interrupted after suction at the home position HP and before suction at the dry suction position K begins (steps 804 to 805 in FIG. 8), the process will be interrupted with ink still inside the cap part 11. If an appropriate initialization process is not performed when the power is turned on, ink may drip from the cap part 11, an ink meniscus may not be properly formed at the ink ejection opening, and good ink ejection may not occur. This problem is avoided, however, by the suction initialization process purging ink that has collected inside the cap part 11 by means of a dry suction step regardless of at what point during the suction process power was cut off.

If the dry suction position K and home position HP cannot be differentiated, separate flags are preferably used to indicate whether the suction process or dry suction process is in progress. This makes it possible to determine the carriage position, and thereby more reliably select the appropriate process to perform at initialization. These flags are further preferably set when the carriage finishes moving to the respective positions. That is, the flag indicating that the suction process is in progress indicates that the suction process operating the pump when the ventilation means or valve is closed has started; the flag indicating that the dry suction process is in progress indicates that the process driving the pump with this valve open has not ended. It is therefore possible to store these respective conditions as status flags.

If the suction process flag is set in the initialization process, operation waits until the internal cap pressure equals the ambient pressure. The carriage is then moved to the dry suction position, the dry suction process is finished, and initialization then proceeds to other normal initialization operations such as home position detection.

If the dry suction process flag is set, the pump is driven for a specific time before moving the carriage to complete the dry suction operation, and the normal initialization process then follows.

If the carriage is located between the suction and dry suction positions when the power supply is interrupted, the suction process flag is set. At the next initialization, the carriage is therefore moved to the dry suction position a distance equivalent to the gap between the suction and dry suction positions. It is to be noted that carriage movement is limited by a stop disposed to the outside of the dry suction position so that the carriage stops at the dry suction position.

If the cleaning process flag stored to EEPROM 112 indicates the rubbing process, the rubbing initialization process shown in FIG. 15 is performed. As shown in the figure, the first step in the rubbing initialization process is moving the carriage 3 to the dry suction position K (1501). Next, the flexible blade 13 is retracted (or if the flexible blade is already retracted it is held in the retracted position), and finally the carriage 3 is moved to the home position HP to complete the process (1502, 1503).

If the power is cut off when the flexible blade 13 is rubbing the nozzle surface 2*a* of print head 2 (step 904 in FIG. 9), the flexible blade 13 will be stopped curved against the nozzle surface 2*a*. If an appropriate initialization process is then not performed when the power is turned on and the carriage 3 moves toward the print area A, that is, is moved in a direction opposite the direction of carriage movement when the nozzle surface is being rubbed, an inappropriate load will be applied to the flexible blade 13. This problem is avoided, however, by the rubbing initialization process first moving the carriage 3 in the same direction in which the carriage 3 is moved for rubbing.

Although the present invention has been described in connection with the preferred embodiments thereof with reference to the accompanying drawings, it is to be noted that various changes and modifications will be apparent to those skilled in the art with reference to the accompanying claims, the detailed description of the invention, and the related art. The present invention has been described, for example, with reference to an ink jet printer capable of performing two different levels of cleaning operations. However, the number of possible cleaning levels, and the specific content of any cleaning level, shall not be limited to the preceding examples.

Furthermore, the print head stopping positions in the standby area B shown in FIG. 4 refer only to one particular embodiment of an ink jet printer, and an ink jet printer according to the present invention can contain other stopping positions and shall not be limited to the above-noted order of stopping positions.

As described above, when a cleaning process is in progress when the power supply is suddenly interrupted as a result of a power failure or inadvertent disconnection of the power cord, an appropriate initialization process is performed by means of the present invention the next time printer power is turned on. As a result, problems such as damage to the cleaning blade and ink drips can be avoided.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. An ink jet printer, wherein the ink jet printer turns off its power in response to a turn-power-off-request signal, said ink jet printer comprising:

an ink jet head having a nozzle disposed on a nozzle surface thereof for ejecting ink, said ink jet head having a predefined power-down position;

a motion actuating mechanism for moving said ink jet head, including the movement of said ink jet head to said predefined power-down position in response to said turn-power-off-request signal prior to the ink jet printer turning off its power;

cleaning means for cleaning said ink jet head using a cleaning sequence including a plurality of cleaning process sub-steps;

initialization control means for initializing the ink jet printer when a supply of power to the ink jet printer starts;

power failure detecting means for detecting a power failure wherein the supply of power to the ink jet printer is abruptly and unexpectedly cut-off, said power failure being unrelated to said turn-power-off-request signal and being effective for preventing an activation of said motion actuating mechanism;

operating status storage means for storing an active status of said plurality of cleaning process sub-steps when said power failure detecting means detects said power failure; and operation selecting means for selecting an operation to be performed by said initialization control means based on the status of said cleaning process sub-steps stored in said operating status storage means, wherein the initial direction of movement of said ink jet head selected by said initialization control means is dependent on which of said cleaning process sub-steps was active at the time of power failure as recorded by said operating status storage means.

2. The ink jet printer according to claim 1, wherein said cleaning means includes sweeping means for performing at least part of said plurality of cleaning process sub-steps, said sweeping means being effective for sweeping the nozzle surface of the ink jet head, wherein said sweeping means has a sweeping status including one of an operating status and a nonoperating status; and wherein said operating status storage means stores said sweeping status.

3. The ink jet printer according to claim 2, wherein said sweeping means includes:

a sweeping member for contacting and sweeping the nozzle surface; and sweeping member drive means for moving the sweeping member in a first direction and a second direction relative to the nozzle surface, and wherein said operating status storage means stores whether said sweeping member is being driven in the first or second direction by said sweeping member drive means when said sweeping means is operating.

4. An ink jet printer comprising:

an ink jet head having a nozzle disposed on a nozzle surface thereof for ejecting ink;

a cleaning means for cleaning said ink jet head including a sweeping means effective for sweeping the nozzle surface of the ink jet head, wherein said sweeping means has a sweeping status including one of an active status and a non-active status, said sweeping means further including a sweeping member for contacting and sweeping the nozzle surface and a sweeping-member drive means for moving the sweeping member in a first direction and in a second direction relative to the nozzle surface;

an initialization control means for initializing the ink jet printer when a supply of power to the ink jet printer starts;

a power failure detecting means for detecting a failure of the supply of power to the ink jet printer;

an operating status storage means for storing said sweeping status when said power failure detecting means detects failure of the supply of power, and if said sweeping means had said active status at the time of the power failure then said operating status storage means further stores data indicating whether said sweeping member was being driven in said first or second direction at the time of power failure; and an operation selecting means for selecting an operation to be performed by said initialization control means including selecting the initial direction of movement in which said sweeping member is driven by said sweeping member drive means, said operation selecting means selecting said first direction as said initial direction of movement if the data stored by said operating status storage indicates that said sweeping member was being driven in said first direction at the time of power failure and selecting said second direction as said initial direction of movement if the data stored by said operating status storage indicates that said sweeping member was being driven in said second direction at the time of power failure.

5. The ink jet printer according to claim 1, wherein said cleaning means includes a suction means for performing at least part of said plurality of cleaning process sub-steps, said suction means being effective for sucking ink from said nozzle, wherein said suction means has a status including one of an operating state and a nonoperating state, and wherein said operating status storage means stores the status of said suction means.

6. The ink jet printer according to claim 5, wherein said suction means includes:

a cap for covering the nozzle surface of said ink jet head and forming a space isolated from outside environment;

cap moving means for moving said cap relative to the nozzle surface and positioning said cap to one of a first position wherein said cap covers the nozzle surface, and a second position wherein said cap does not cover the nozzle surface;

ventilation means, having an open position and a closed position, for connecting the space formed by said cap to the outside environment when said ventilation means is in the open position; and a pump connected to said cap for sucking through said cap at least one of air, particles and ink inside said cap; and wherein the operating status storage means stores at least one of a first suction means operating status and a second suction means operating status when said suction means is in the operating state, wherein said first suction means operating status is indicative that a first suction process has started where said first suction process operates said pump when said ventilation means is in the closed position, and wherein said second suction means operating status is indicative that a second suction process has not ended where said second suction process operates said pump when said ventilation means is in the open position.

7. An ink jet printer comprising, an ink jet head having a nozzle disposed on a nozzle surface thereof for ejecting ink, said ink jet printer being effective for moving said ink jet head to a predefined home position in response to a turn-power-off-request signal prior to turning off its power;

a cleaning means for cleaning said ink jet head, said cleaning means including a suction means for sucking ink from said nozzle, said suction means including:

a) a cap for covering the nozzle surface of said ink jet head and forming an inner space within said cap;

b) a cap moving means for moving said cap relative to the nozzle surface and positioning said cap to one of a first position wherein said cap covers the nozzle surface and a second position wherein said cap does not cover the nozzle surface;

c) a ventilation means having an open position and a closed position, said ventilation means being effective for connecting said inner space of the cap to an outside environment when said ventilation means is in the open position and isolating said inner space of the cap from the outside environment when said ventilation means is in the closed position; and d) a pump connected to said cap for sucking through said cap at least one of air, particles, and ink from inside said cap;

said suction means having a suction operating status indicative of a first active state for a first suction mode wherein said pump is operated while said ventilation mean is in said closed position, a second active state for a second suction mode wherein said pump is operated while said ventilation means is in said opened position, and a non-active state wherein said suction means is not operated;

initialization control means for initializing the ink jet printer when a supply of power to the ink jet printer starts;

power failure detecting means for detecting a power failure wherein the supply of power to the ink jet printer is abruptly and unexpectedly cut-off, said power failure being unrelated to said turn-power-off-request signal and being effective for preventing the movement of said ink jet head;

operating status storage means for storing at least said suction operating status when said power failure detecting means detects said power failure; and operation selecting means for selecting an operation to be performed by said initialization control means based on the status stored in said operating status storage means, wherein said operation selecting means selects a suction operation to be performed by said initialization control means prior to any movement of said inkjet head and said cap when said suction operation status is not said non-active state, said operation selecting means further selecting said first suction mode when said first active state is stored and selecting said second suction mode when said second active mode is stored.

8. A control method for an ink jet printer, comprising the steps of:

(a) cleaning an ink jet head having a nozzle disposed on a nozzle surface thereof for ejecting ink, wherein the cleaning of said ink jet head uses a cleaning sequence including a plurality of cleaning process sub-steps;

(b) initializing the ink jet printer when power supplied to the ink jet printer starts;

(c1) responding to a turn-power-off-request signal by assuring that said ink jet head is in a predefined home-position prior to initiating the turning off of the ink jet printer's power supply;

(c2) detecting any unexpected power failure wherein the power supplied to the ink jet printer is abruptly cut-off and it cannot be assured that said ink jet head is in said predefined home-position;

(d) storing an active status of said plurality of cleaning process sub-steps when the power failure detecting step (c2) detects the power failure; and (e) selecting an operation to be performed by the initialization step (b) based on the active status of said plurality of cleaning process sub-steps stored in the active status storing step (d), wherein the initial direction of movement of said ink jet head is selected based on which, if any, of said cleaning process sub-steps was active at the time of power failure as recorded in the operating status storing step (d).

9. A control method for an ink jet printer, comprising the steps of:

(a) cleaning an ink jet head having a nozzle disposed on a nozzle surface thereof for ejecting ink, wherein the cleaning of said ink jet head uses a cleaning sequence including a plurality of cleaning process sub-steps;

(b) initializing the ink jet printer when power supplied to the ink jet printer starts;

(c) detecting failure of the power supplied to the ink jet printer;

(d) storing an active status of said plurality of cleaning process sub-steps when the power failure detecting step (c) detects failure of the power supplied to the ink jet printer; and (e) selecting an operation to be performed by the initialization step (b) based on the active status of said plurality of cleaning process sub-steps stored in the active status storing step (d), wherein the initial direction of movement of said ink jet head is selected based on which, if any, of said cleaning process sub-steps was active at the time of power failure as recorded in the operating status storing step (d);

wherein said plurality of cleaning process sub-steps of step (a) include the step of:

(a1) sweeping the nozzle surface of the ink jet head; and wherein the active status storing step (d) includes the step of (d1) storing a status indicative of whether the sweeping step (a1) is in progress.

10. The initialization control method according to claim 9, wherein the sweeping step (a1) includes the steps of:

(a11) moving a sweeping member for contacting and sweeping the nozzle surface in a first direction, and (a12) moving the sweeping member in a second direction different from said first direction; and wherein the active status storing step (d) includes the step of (d2) storing a status indicative of whether the first moving step (a11) or second moving process (a12) is in progress when the sweeping step (a1) is in progress.

11. The initialization control method according to claim 10, wherein the operation selecting step (e) includes the steps of:

(e1) selecting as the initial direction of movement of the sweeping member in the initialization step (b) the first direction when the storing step (d2) stores the first moving step (a11) as being in progress; and (e2) selecting as the initial direction of movement of the sweeping member in the initialization step (b) the second direction when the storing step (d2) stores the second moving step (a12) as being in progress.

12. The initialization control method according to claim 8, wherein said plurality of cleaning process sub-steps of step (a) include the step of:

(a2) sucking ink from said nozzle; and wherein the active status storing step (d) includes the step of (d3) storing a status indicative of whether the suction step (a2) is in progress.

13. The initialization control method according to claim 12, wherein the suction step (a2) includes the steps of:

(a21) moving a cap to a first position relative to the nozzle, covering the ink jet head nozzle, and forming a space isolated from an outside environment;

(a22) moving a cap to a second position relative to the nozzle, and removing the cap from the ink jet head nozzle;

(a23) opening a ventilation means and ventilating to the outside environment the space formed by the cap covering the nozzle; and (a24) sucking through the cap at least one of air, particles and ink inside said cap by means of a pump connected to the cap; and wherein the active status storing step (d) includes at least one of the steps of:

(d4) storing a first status indicative that the pumping step (a24) started following the capping step (a21) during processing of the suction step (a2); and (d5) storing a second status indicative that the pumping step (a24) following the ventilating step (a23) during processing of the suction step (a2) has not ended.

14. A control method for an ink jet printer, said method comprising:

(a) cleaning an ink jet head having a nozzle disposed on a nozzle surface thereof for ejecting ink, wherein the cleaning of said ink jet head uses a cleaning sequence including a suction step sucking ink from said nozzle, said suction step including the following steps in various sequence combinations:

(I) moving a cap to a first position relative to the nozzle, covering the ink jet head nozzle, and forming a space isolated from an outside environment;

(II) moving a cap to a second position relative to the nozzle, and removing the cap from the ink jet head nozzle;

(III) opening a ventilation means and ventilating to the outside environment the space formed by the cap covering the nozzle; and (IV) sucking through the cap at least one of air, particles and ink inside said cap by means of a pump connected to the cap;

(b1) moving the ink jet head to a predefined home position in response to a turn-power-off-request signal prior to turning off the printer's power;

(b2) initializing the ink jet printer when power supplied to the ink jet printer starts;

(c) detecting a power failure wherein the power supplied to the ink jet printer is abruptly and unexpectedly cut-off resulting in an inability to move the ink jet head to said predefined home position, said power failure being unrelated to said turn-power-off-request signal and being effective for preventing the movement of said ink jet head;

(d) storing an active status of said cleaning sequence when the power failure detecting step (c) detects said power failure, including at least storing if said suction step IV was active at the time of power failure detection; and (e) an operation selection step for selecting an operation to be performed by the initialization step (b2) based on the active status of said cleaning sequence stored in the active status storing step (d), said operation selection step further requiring the selecting of suction step III and step IV in sequence before execution of any other operation that requires movement of said ink jet head when the active status storing step (d) stores that said suction step IV was active at the time of power failure detection.

15. A computer-readable storage medium for storing instructions executed by a computer for accomplishing a control method for an ink jet printer to perform the steps of:

(a) cleaning an ink jet head having a nozzle disposed on a nozzle surface thereof for ejecting ink, wherein the cleaning of said ink jet head uses a cleaning sequence including a plurality of cleaning process sub-steps;

(b1) moving the ink jet head to a predefined home position in response to a turn-power-off-request signal prior to turning off the power;

(b2) initializing the ink jet printer when power supplied to the ink jet printer starts;

(c) detecting a power failure wherein the power supplied to the ink jet printer is abruptly and unexpectedly cut-off, said power failure being unrelated to said turn-power-off-request signal and being effective for preventing the movement of said ink jet head to said predefined home position;

(d) storing an active status of said plurality of cleaning process sub-steps when the power failure detecting step (c) detects said power failure; and (e) selecting an operation to be performed by the initialization step (b2) based on the active status of said plurality of cleaning process sub-steps stored in the active status storing step (d), wherein the initial direction of movement of said ink jet head is selected based on which, if any, of said cleaning process sub-steps was active at the time of power failure as recorded in the active status storing step (d).

16. A computer-readable storage medium for storing instructions executed by a computer for accomplishing a control method to perform the steps of:

(a) cleaning an ink jet head having a nozzle disposed on a nozzle surface thereof for ejecting ink, wherein the cleaning of said ink jet head uses a cleaning sequence including a plurality of cleaning process sub-steps;

(b) initializing the ink jet printer when power supplied to the ink jet printer starts;

(c) detecting failure of the power supplied to the ink jet printer;

(d) storing an active status of said plurality of cleaning process sub-steps when the power failure detecting step (c) detects failure of the power supplied to the ink jet printer; and (e) selecting an operation to be performed by the initialization step (b) based on the active status of said plurality of cleaning process sub-steps stored in the active status storing step (d), wherein the initial direction of movement of said ink jet head is selected based on which, if any, of said cleaning process sub-steps was active at the time of power failure as recorded in the active status storing step (d);

wherein said plurality of cleaning process sub-steps of cleaning step (a) include the step of:

(a1) sweeping the nozzle surface of the ink jet head, wherein the active status storing step (d) includes the step of (d1) storing a status indicative of whether the sweeping step (a1) is in progress.

17. The computer-readable storage medium according to claim 16, wherein the sweeping step (a1) includes the steps of:

(a11) moving a sweeping member for contacting and sweeping the nozzle surface in a first direction, and (a12) moving the sweeping member in a second direction different from said first direction; and wherein the active status storing step (d) includes the step of (d2) storing a status indicative of whether the first moving step (a11) or second moving process (a12) is in progress when the sweeping step (a1) is in progress.

18. The computer-readable storage medium according to claim 17, wherein the operation selection step (e) includes the steps of:

(e1) selecting as the initial direction of movement of the sweeping member in the initialization step (b) the first direction when the storing step (d2) stores the first moving step (a11) as being in progress; and (e2) selecting as the initial direction of movement of the sweeping member in the initialization step (b) the second direction when the storing step (d2) stores the second moving step (a12) as being in progress.

19. The computer-readable storage medium according to claim 15, wherein the cleaning step (a) includes the step of (a2) sucking ink from said nozzle; and wherein the active status storing step (d) includes the step of (d3) storing a status indicative of whether the suction step (a2) is in progress.

20. The computer-readable storage medium according to claim 19, wherein the suction step (a2) includes the steps of:

(a21) moving a cap to a first position relative to the nozzle, covering the ink jet head nozzle, and forming a space isolated from an outside environment;

(a22) moving a cap to a second position relative to the nozzle, and removing the cap from the ink jet head nozzle;

(a23) opening a ventilation means and ventilating to the outside environment the space formed by the cap covering the nozzle; and (a24) sucking through the cap at least one of air, particles and ink inside said cap by means of a pump connected to the cap; and wherein the active status storing step (d) includes at least one of the steps of:

(d4) storing a first status indicative that the pumping step (a24) started following the capping step (a21) during processing of the suction step (a2); and (d5) storing a second status indicative that the pumping step (a24) following the ventilating step (a23) during processing of the suction step (a2) has not ended.

21. A computer-readable storage medium for storing instructions executed by a computer for accomplishing a control method for an ink jet printer to perform the steps of:

(a) cleaning an ink jet head having a nozzle disposed on a nozzle surface thereof for ejecting ink, wherein the cleaning of said ink jet head uses a cleaning sequence including a suction step sucking ink from said nozzle, said suction step including the following steps in various sequence combinations:

(I) moving a cap to a first position relative to the nozzle, covering the ink jet head nozzle, and forming a space isolated from an outside environment;

(II) moving a cap to a second position relative to the nozzle, and removing the cap from the ink jet head nozzle;

(III) opening a ventilation means and ventilating to the outside environment the space formed by the cap covering the nozzle; and (IV) sucking through the cap at least one of air, particles and ink inside said cap by means of a pump connected to the cap;

(b) initializing the ink jet printer when power supplied to the ink jet printer starts;

(c1) moving the ink jet head to a predefined home position in response to a turn-power-off-request signal prior to turning off the power;

(c2) detecting a power failure wherein the power supplied to the ink jet printer is abruptly and unexpectedly cut off resulting in an inability to move the ink jet head to said predefined home position;

(d) storing an active status of said cleaning sequence when the power failure detecting step (c2) detects said power failure, including at least storing if said suction step IV was active at the time of power failure detection; and (e) an operation selection step for selecting an operation to be performed by the initialization step (b) based on the active status of said cleaning sequence stored in the active status storing step (d), said operation selection step further requiring the selecting of suction step III and step IV in sequence before execution of any other operation that requires movement of said ink jet head when the operating status storing step (d) stores that said suction step IV was active at the time of power failure detection.

22. An ink jet printer, wherein the ink jet printer turns off its power in response to a turn-power-off-request signal, said ink jet printer comprising:

an ink jet head having a nozzle disposed on a nozzle surface thereof for ejecting ink, said ink jet head having a predefined power-down position;

a motion actuating mechanism for moving said ink jet head, including the movement of said ink jet head to said predefined power-down position in response to said turn-power-off-request signal prior to the ink jet printer turning off its power;

a cleaner to clean said ink jet head using a cleaning sequence including a plurality of cleaning process sub-steps;

an initialization controller to initialize the ink jet printer when a supply of power to the ink jet printer starts;

a power supply failure detector to detect a power failure wherein the supply of power to the ink jet printer is abruptly and unexpectedly cut-off, said power failure being unrelated to said turn-power-off-request signal and being effective for preventing the activation of said motion actuating mechanism;

an operating status memory to store a current active status of said plurality of cleaning process sub-steps when said power supply failure detector detects said power failure; and an operation selector to select an operation to be performed by said initialization controller based on the current active status of said plurality of cleaning process sub-steps stored in said operating status memory, wherein the initial direction of movement of said ink jet head selected by said initialization controller is dependent on which of said cleaning process sub-steps was active at the time of power failure as recorded by said operating status memory.

23. The ink jet printer according to claim 22, wherein said cleaner includes a blade to sweep the nozzle surface of the ink jet head, the sweeping of said nozzle surface being part of said plurality of cleaning process sub-steps, wherein said blade has a blade status including one of an operating status and a nonoperating status; and wherein said operating status memory stores the blade status.

24. The ink jet printer according to claim 23, wherein said blade includes:

a sweeper member to contact and sweep the nozzle surface; and a sweeper member driver to move the sweeper member in a first direction and a second direction relative to the nozzle surface, and wherein said operating status memory stores whether said sweeper member is being driven in the first or second direction by said sweeper member driver when said sweeper is operating.

25. An ink jet printer comprising:

an ink jet head having a nozzle disposed on a nozzle surface thereof for ejecting ink;

a cleaner to clean said ink jet head including a sweeping means effective for sweeping the nozzle surface of the ink jet head, wherein said sweeping means has a sweeping status including one of an active status and a non-active status, said sweeping means further including a sweeping member for contacting and sweeping the nozzle surface and a sweeping-member drive means for moving the sweeping member in a first direction and in a second direction relative to the nozzle surface;

initialization controller to initialize the ink jet printer when a supply of power to the ink jet printer starts;

a power supply failure detector to a failure of the supply of power to the ink jet printer;

an operating status memory to store said sweeping status when said power failure detector detects failure of the supply of power, and if said sweeping means had said active status at the time of the power failure then said operating status memory further stores data indicating whether said sweeping member was being driven in said first or second direction at the time of power failure; and an operation selector to select an operation to be performed by said initialization control means including selecting the initial direction of movement in which said sweeper member is driven by said sweeper member driver, said operation selector selects said first direction as said initial direction of movement if the data stored by said operating status storage indicates that said sweeper member was being driven in said first direction at the time of power failure and selecting said second direction as said initial direction of movement if the data stored by said operating status storage indicates that said sweeper member was being driven in said second direction at the time of power failure.

26. The ink jet printer according to claim 22, wherein said cleaner includes a vacuum generator to vacuum ink from said nozzle, the vacuuming of ink being part of said plurality of cleaning process sub-steps, wherein said vacuum generator has a status including one of an operating state and a nonoperating state, and wherein said operating status memory stores the status of said vacuum generator.

27. The ink jet printer according to claim 26, wherein said vacuum generator includes:

a cap for covering the nozzle surface of said ink jet head and forming a space isolated from outside environment;

a cap mechanism to move said cap relative to the nozzle surface and positioning said cap to one of a first position wherein said cap covers the nozzle surface, and a second position wherein said cap does not cover the nozzle surface;

vent, having an open position and a closed position, for connecting the space formed by said cap to the outside environment when said vent is in the open position; and a pump connected to said cap for sucking through said cap at least one of air, particles and ink inside said cap; and wherein the operating status memory stores at least one of a first vacuum generator operating status and a second vacuum generator operating status when said vacuum generator is in the operating state, wherein said first vacuum pump operating status is indicative that a first suction process has started where said first suction process operates said pump when said vent is in the closed position, and wherein said second vacuum pump operating status is indicative that a second suction process has not ended where said second suction process operates said pump when said vent is in the open position.

28. An ink jet printer comprising:

an ink jet head having a nozzle disposed on a nozzle surface thereof for ejecting ink;

a cleaner to clean said ink jet head, said cleaner including a vacuum generator to vacuum ink from said nozzle, said vacuum generator including:

a) a cap for covering the nozzle surface of said ink jet head and forming a space isolated from outside environment;

b) a cap mechanism to move said cap relative to the nozzle surface and positioning said cap to one of a first position wherein said cap covers the nozzle surface and a second position wherein said cap does not cover the nozzle surface;

c) a vent having an open position and a closed position, said vent being effective for connecting the space formed by said cap to the outside environment when said vent is in the open position and isolating the space formed by said cap from the outside environment when said vent is in the closed position; and d) a pump connected to said cap for sucking through said cap at least one of air, particles, and ink from inside said cap;

said vacuum generator having a suction operating status indicative of a first active state for a first suction mode wherein said pump is operated while said vent is in said closed position, a second active state for a second suction mode wherein said pump is operated while said vent is in said opened position, and a non-active state wherein said vacuum generator is not operated;

an initialization controller to initialize the ink jet printer when a supply of power to the ink jet printer starts, the initializing of the ink jet printer including at least the execution of a home-seeking routine wherein the ink head is moved to a predefined home position if the ink head is not already in said predefined home position when the supply of power to the ink jet printer starts;

a power-down-sequence controller for executing a power-down sequence in response to a turn-power-off-request signal, said power-down sequence including at least the moving of the print head to said predefined home position prior to turning off the power;

a power supply failure detector for detecting a power failure wherein the supply of power to the ink jet printer is abruptly and unexpectedly cut off resulting in said print head not being moved to said predefined home position, said power failure being unrelated to said turn-power-off-request;

an operating status memory to store at least said suction operating status when said power failure detector detects said power failure; and an operation selector to select an operation to be performed by said initialization controller based on the status stored in said operating status memory, wherein said operation selector selects a suction operation to be performed by said initialization controller prior to execution of said home-seeking routine and prior to any movement of said inkjet head cap when said suction operation status is not said non-active state, said operation selector further selecting said first suction mode prior to execution of said home-seeking routine when said first active state is stored, and selecting said second suction mode prior to execution of said home-seeking routine when said second active mode is stored.

* * * * *